US009476217B2

(12) United States Patent
MacCallum et al.

(10) Patent No.: US 9,476,217 B2
(45) Date of Patent: Oct. 25, 2016

(54) MINE EMERGENCY REFUGE SYSTEMS

(71) Applicant: Paragon Space Development Corporation, Tucson, AZ (US)

(72) Inventors: Taber K. MacCallum, Tucson, AZ (US); Barry Wynns Finger, Kemah, TX (US); David Zuniga, Houston, TX (US); Brian F. Richardson, Tucson, AZ (US); Jason H. Brockbank, Tucson, AZ (US); Stephanie Sharo Chiesi, Tucson, AZ (US); Tyler M. Ball, Sahuarita, AZ (US)

(73) Assignee: Paragon Space Development Corporation, Tucson, AZ (US)

( * ) Notice: Subject to any disclaimer, the term of this patent is extended or adjusted under 35 U.S.C. 154(b) by 213 days.

(21) Appl. No.: 13/762,165

(22) Filed: Feb. 7, 2013

(65) Prior Publication Data

US 2013/0199423 A1 Aug. 8, 2013

Related U.S. Application Data

(60) Provisional application No. 61/596,678, filed on Feb. 8, 2012.

(51) Int. Cl.
*E21F 11/00* (2006.01)
*E04H 9/14* (2006.01)

(52) U.S. Cl.
CPC ..... *E04H 9/14* (2013.01); *E21F 11/00* (2013.01)

(58) Field of Classification Search
CPC ..... E21F 11/00; E21F 1/145; E21F 17/107; E21F 17/12
USPC ..... 52/2.13, 2.17
See application file for complete search history.

(56) References Cited

U.S. PATENT DOCUMENTS

| | | | | |
|---|---|---|---|---|
| 5,603,185 | A * | 2/1997 | Murphy | 52/2.17 |
| 5,706,846 | A | 1/1998 | Sutton | |
| 6,875,119 | B2 * | 4/2005 | Murphy et al. | 472/134 |
| 7,533,942 | B2 | 5/2009 | Kennedy et al. | |
| 8,007,047 | B2 | 8/2011 | Kennedy et al. | |
| 2007/0200420 | A1 * | 8/2007 | McCormick | 299/95 |
| 2008/0106137 | A1 * | 5/2008 | Paton-Ash et al. | 299/12 |
| 2008/0120919 | A1 * | 5/2008 | VanBasten et al. | 52/2.17 |
| 2008/0190032 | A1 | 8/2008 | Roelofs | |
| 2008/0196329 | A1 * | 8/2008 | Kennedy et al. | 52/169.6 |
| 2009/0084126 | A1 * | 4/2009 | Schartel | 62/260 |
| 2009/0133730 | A1 | 5/2009 | McVey | |
| 2009/0197518 | A1 | 8/2009 | Reuther et al. | |
| 2010/0018391 | A1 * | 1/2010 | Whittaker et al. | 95/23 |
| 2010/0071393 | A1 | 3/2010 | Tatton et al. | |

(Continued)

FOREIGN PATENT DOCUMENTS

WO WO 2005/052319 6/2005

OTHER PUBLICATIONS

Virtual Mine eXpo, Underground Mine Refuge Chambers, http://virtualminexpo.com/RefugeChambers.htm, Last Accessed: Feb. 5, 2013, Published Sep. 4, 2007.

(Continued)

*Primary Examiner* — John Kreck
*Assistant Examiner* — Michael Goodwin
(74) *Attorney, Agent, or Firm* — Weaver Austin Villeneuve & Sampson LLP

(57) ABSTRACT

An emergency refuge system relating to improved occupant access and air revitalization.

33 Claims, 23 Drawing Sheets

(56) References Cited

U.S. PATENT DOCUMENTS

| | | | | |
|---|---|---|---|---|
| 2010/0175334 | A1* | 7/2010 | McDonald et al. | 52/79.9 |
| 2011/0107681 | A1* | 5/2011 | Zhang | 52/2.17 |
| 2014/0075849 | A1* | 3/2014 | Heim et al. | 52/2.22 |

OTHER PUBLICATIONS

A. L. Lee Corporation, Rescue Chamber, http://www.alleecorp.com/rescue-chamber, Last Accessed: Feb. 5, 2013, Published on or About Jul. 9, 2012.

Carbonoks LLC, A Rescue Chamber Capable of Protecting the Miner, http://www.carbonoks.com, Last Accessed: Feb. 5, 2013, Date of Publication Unknown.

ChemBio Shelter, Inc., Lifeshelter, http://chembioshelter.com/products/lifeshelter/, Last Accessed: Feb. 5, 2013, Date of Publication Unknown.

DEA Incorporated, Our Products—Refuge Chambers, http://www.deainc.net/refugechambers.shtml, Last Accessed: Feb. 5, 2013, Date of Publication Unknown.

Drager, Rescue & Shelter Systems—Rescue and Refuge Systems, http://www.draeger.us/Sites/enus_us/Pages/Mining/Refuge-and-Rescue-Chambers.aspx?navID=93, Last Accessed: Feb. 5, 2013, Date of Publication Unknown.

Holywell Engineeering, Rescue Chambers, http://www.holywell.com/mining-products/rescue-chambers.asp, Last Accessed: Feb. 5, 2013, Date of Publication Unknown.

mineARC Systems, Welcome to MineARC, http://www.minearc.com.au/, Last Accessed: Feb. 5, 2013, Date of Publication Unknown.

mineARC Systems, MineARC Refuge Chambers & Safe Havens, http://www.minearc.com.au/product/coal-mines-portable/standard-aus, Last Accessed: Feb. 5, 2013, Date of Publication Unknown.

BioPak 240 Revolution, Benchman Instruction Manual, Feb. 2008, p. 25, Document: A47D135, Revision: I, Part No. B5-06-6000-15-0, Biomarine-Ntron, Inc., Exton, Pennsylvsania, U.S.A.

MHSS—Mining Health & Safety Solutions, Mine Refuge Alternative, http://www.mininghealthandsafety.com/page.php/refugechambercoal/Refuge-Chambers.html, Last Accessed: Feb. 5, 2013, Date of Publication Unknown.

North Fringe Group Inc., Pumps—Process Equipment, http://www.northfringe.com/index.php, Last Accessed: Feb. 5, 2013, Date of Publication Unknown.

RANA Mine Refuge Systems, A Safe Haven for Miners, http://www.ranacaregroup.com/mine-refuge-systems, Last Accessed: Feb. 5, 2013, Date of Publication Unknown.

Shairzal Safety Engineering, Emergency Refuge Stations, http://www.shairzal.com.au/refuge_chambers.php, Last Accessed: Feb. 5, 2013, Date of Publication Unknown.

Strata Worldwide, Chambers, http://www.strataworldwide.com/chambers, Last Accessed: Feb. 5, 2013, Date of Publication Unknown.

International Search Report and Written Opinion, International Application No. PCT/US2013/025337, dated May 14, 2013 (9 pages).

* cited by examiner

MINE EMERGENCY REFUGE SYSTEMS

CROSS-REFERENCE TO RELATED APPLICATION

The present application is related to and claims priority from prior provisional application Ser. No. 61/596,678, filed Feb. 8, 2012, entitled "MINE EMERGENCY REFUGE SYSTEMS", the content of which is incorporated herein by this reference and is not admitted to be prior art with respect to the present invention by the mention in this cross-reference section.

BACKGROUND

This invention relates to providing a system for improved mine emergency refuges. More particularly, this invention relates to providing emergency mine refuge systems with improved air revitalization and refuge access.

Each occurrence of a major underground mining incident highlights the need for improved evacuation and refuge alternatives for human miners. Fire, explosions, gas inundation, ground movement, etc., may prevent the miner from immediately exiting the mine subsequent to an emergency incident. When escape is impossible, miners must take temporary refuge within the mine until rescue assistance is available or the mine is secured.

Clearly, a need exists for new technologies designed to improve the safety of underground mining operations by enabling the implementation of life-sustaining emergency refuges for persons temporarily trapped in an underground mine.

OBJECTS AND FEATURES OF THE INVENTION

A primary object and feature of the present invention is to provide a system overcoming the above-mentioned problem (s).

It is a further object and feature of the present invention to provide such an emergency refuge system with improved user access and air revitalization. It is another object and feature of the present invention to provide a method for limiting the introduction of airborne contamination into the emergency refuges. Yet another object and feature of the present invention is to provide a barrier passageway for emergency refuges allowing rapid occupant access to the refuge while limiting migration of airborne contaminants across the passageway barrier.

Yet another object and feature of the present invention is to provide a passageway that substantially conforms to the shape of the person or object passing through the passageway. Yet another object and feature of the present invention is to provide a passageway that automatically recovers to a closed state after passage of a user. Yet another object and feature of the present invention is to use elastic bodies in a passageway. Yet another object and feature of the present invention is to provide for a self-closing seal in an entryway. Yet another object and feature is to use a source of fluid to actuate the actions of the passageway. Yet another object and feature is to allow the passageway to be fastened to the structure separating two environments.

Another object and feature of the present invention is to provide a means for removal of carbon dioxide and trace contaminants from within the refuge environment. Yet another object and feature of the present invention is to remove metabolically generated organic compounds that pose a hazard to the occupants.

Yet another object and feature of the present invention is to provide such a system comprising emergency refuges with structures and features adapted to use within underground mine environments.

A further primary object and feature of the present invention is to provide such a system that is efficient, inexpensive, and useful. Other objects and features of this invention will become apparent with reference to the following descriptions.

SUMMARY OF THE INVENTION

In accordance with a preferred embodiment hereof, this invention provides a system, relating to reducing contamination potential in a first area adjacent to a second area, which is potentially contaminable, while permitting passage of at least one object from the second area to the first area, comprising: at least one first separator to separate the first area from the second area; wherein such at least one first separator comprises; at least one deformable separator region structured and arranged to deform under at least one force load applied to such at least one first separator by the at least one object, at least one passageway structured and arranged to permit passing the at least one object through such at least one first separator on sufficient deformation of such at least one deformable separator region, and at least one deformation corrector structured and arranged to correct such deformation sufficiently to restore the separating of such at least one first separator; wherein such at least one first separator comprises at least one fluid-inflatable bladder to assist such deformation and such deformation-correction; and wherein such at least one first separator provides reduced contamination potential in the first area adjacent to the second area, which is potentially contaminable, while permitting passage of the at least one object from the second area to the first area when the second area may actually contain contamination.

Moreover, it provides such a system wherein such at least one deformable separator region comprises at least one damage-resister structured and arranged to resist damage from the passing through of the at least one object and from such contamination. Additionally, it provides such a system further comprising: at least one life-supporting enclosure structured and arranged to enclose such first area; wherein such at least one life-supporting enclosure comprises at least one enclosure wall structured and arranged to enclose, within such first area, at least one breathable atmosphere for one or more human occupants; wherein such at least one first separator is structured and arranged to permit passage of the one or more human occupants, through such at least one enclosure wall, from the second area to the first area within such at least one life-supporting enclosure.

Also, it provides such a system wherein: such at least one life-supporting enclosure comprises at least one mine emergency refuge structured and arranged to provide refuge for miners during a period of mine contamination in a mine emergency; the system further comprising: at least one life-support unit structured and arranged to maintain the at least one breathable atmosphere in a condition consistent with sustaining the health of the one or more human occupants; wherein such at least one life-support unit comprises at least one toxic-compound remover structured and arranged to remove at least one toxic compound from the at least one breathable atmosphere. In addition, it provides such a system wherein such at least one toxic-compound remover comprises at least one carbon dioxide remover structured and arranged to remove carbon dioxide from the at least one breathable atmosphere. And, it provides such a system wherein such at least one toxic-compound remover comprises at least one ammonia remover structured and arranged to remove ammonia from the at least one breathable atmosphere. Further, it provides such a system wherein such at least one toxic-compound remover comprises at least one carbon monoxide remover structured and arranged to remove carbon monoxide from the at least one breathable atmosphere. Even further, it provides such a system wherein such at least one toxic-compound remover further comprises: at least one carbon dioxide remover structured and arranged to remove carbon dioxide from the at least one breathable atmosphere; and at least one ammonia remover structured and arranged to remove ammonia from the at least one breathable atmosphere.

Moreover, it provides such a system wherein such at least one life-support unit comprises: at least one air conductor structured and arranged to conduct at least one airflow derived from the at least one breathable atmosphere; at least one inlet to inlet the at least one airflow comprising at least one portion of at least one breathable atmosphere; at least one outlet to outlet the at least one airflow from such at least one air conductor; and at least one air movement generator structured and arranged to generate movement of the at least one airflow between such at least one inlet and such at least one outlet; wherein such at least one air conductor comprises such at least one toxic-compound remover; and wherein the at least one toxic compound is removed from the at least one breathable atmosphere by interaction between the at least one airflow and such at least one toxic-compound remover.

Additionally, it provides such a system further comprising at least one oxygen maintainer structured and arranged to maintain, within the at least one breathable atmosphere, at least one life-sustaining level of oxygen. Also, it provides such a system wherein such at least one passageway comprises: within such at least one enclosure wall, at least one entrance opening to provide to the one or more human occupants, entrance to such at least one passageway, such at least one first separator, and at least one second separator structured and arranged to further separate such at least one passageway from the second area.

In addition, it provides such a system wherein such at least one fluid-inflatable bladder comprises: at least one continuous bladder wall structured and arranged to contain at least one inflation fluid; wherein such at least one continuous bladder wall comprises at least one flexible material capable of deforming under the at least one force load applied to such at least one continuous bladder wall by the at least one object.

Additionally, it provides such a system wherein such at least one second separator comprises: at least one cover hatch to sealably cover such at least one entrance opening; wherein such at least one cover hatch is structured and arranged to be configurable between at least one open position and at least one closed position; wherein such at least one cover hatch, when configured in the at least one open position, allows passage of the one or more human occupants through such at least one entrance opening; and wherein such at least one cover hatch, when configured in the at least one closed position, prevents movement of airborne containments through such at least one entrance opening.

Further, it provides such a system further comprising: at least one bladder inflator to inflate such at least one fluid-inflatable bladder using the at least one inflation fluid; wherein such at least one bladder inflator comprises at least one inflation controller to control delivery of the at least one inflation fluid to each such at least one fluid-inflatable bladder of such at least one first separator; wherein such at least one inflation controller comprises at least one trigger structured and arranged to trigger such inflation of such at least one fluid-inflatable bladder as such at least one cover hatch is unsealed.

Even further, it provides such a system wherein such at least one first separator further comprises: at least two fluid-inflatable bladders comprising at least one upper fluid-inflatable bladder and at least one lower fluid-inflatable bladder; wherein such at least one upper fluid-inflatable bladder comprises at least one upper deformable separator region and such at least one lower fluid-inflatable bladder comprises at least one lower deformable separator region; wherein such at least one upper deformable separator region is arranged to be in separable contact with such at least one lower deformable separator region; wherein such at least one passageway through such at least one first separator is formable by sufficient deformation of either one of such at least one upper deformable separator region and such at least one lower deformable separator region.

Moreover, it provides such a system wherein: contact between such at least one upper deformable separator region and such at least one lower deformable separator region forms at least one releasable passage seal structured and arranged to releasably seal such at least one passageway formable between such at least two fluid-inflatable bladders; wherein such at least one releasable passage seal prevents movement of the airborne containments through such at least one first separator. Additionally, it provides such a system wherein each one of such at least two fluid-inflatable bladders comprise a tubular shape having a lateral length extending between at least one first end closure and at least one second end closure.

In addition, it provides such a system further comprising: at least one bladder inflator to inflate such at least one fluid-inflatable bladder using the at least one inflation fluid; and wherein such at least one bladder inflator comprises at least one inflation controller to control delivery of the at least one inflation fluid to each such at least one fluid-inflatable bladder of such at least one first separator. In addition, it provides such a system wherein: such at least one releasable passage seal extends continuously along such lateral length; and such at least one releasable passage seal is oriented substantially horizontally.

Furthermore, it provides such a system further comprising: at least one airborne-contaminants purger structured and arranged to purge such at least one passageway of airborne contaminants; wherein such at least one bladder inflator is structured and arranged to utilize breathable air as the at least one inflation fluid; wherein such at least one flexible material of such bladder is at least partially permeable to the passage of the breathable air; and wherein at least a portion of the breathable air permeating from such bladder displaces the airborne contaminants within such at least one passageway. Further, it provides such a system wherein such at least one flexible material of each one of such fluid-inflatable bladders comprises at least one air permeable material having a plurality of holes distributed at least partially along such lateral length. Even further, it provides such a system wherein such at least one passageway further comprises at least one third separator to further separate the first area from the second area. Moreover, it provides such a system wherein such at least one third separator comprises: such at least one deformable separator region structured and arranged to deform under at least one force load applied to such at least one first separator by the at least one object, such at least one passageway structured and arranged to permit passing the at least one object through such at least one first separator on sufficient deformation of such at least one deformable separator region, and such at least one deformation corrector structured and arranged to correct such deformation sufficiently to restore the separating of such at least one first separator. Additionally, it provides such a system wherein such at least one third separator comprises structures and arrangements matching substantially those of such at least one first separator.

In accordance with another preferred embodiment hereof, this invention provides a mine emergency refuge system, for providing at least one protective enclosure as a refuge for one or more mine personnel during a period of mine contamination in a mine emergency, comprising: at least one separator structured and arranged to separate at least one contaminable mine area from at least one adjacent mine refuge area; wherein such at least one separator comprises at least one deformable separator region structured and arranged to deform under at least one force load applied to such at least one separator by the one or more mine personnel, at least one passageway structured and arranged to permit passing the one or more mine personnel through such at least one separator on sufficient deformation of such at least one deformable separator region, and at least one deformation corrector structured and arranged to correct such deformation sufficiently to restore the separating of such at least one separator; wherein such at least one separator provides reduced contamination potential in the at least one mine refuge area adjacent to the at least one contaminable mine area while permitting passage of the one or more mine personnel from the at least one contaminated mine area to the at least one mine refuge area.

Also, it provides such a mine emergency refuge system further comprising: such at least one protective enclosure; wherein such at least one protective enclosure comprises at least one enclosure wall structured and arranged to enclose at least one breathable atmosphere for the one or more mine personnel; wherein such at least one separator is structured and arranged to permit passage of the one or more mine personnel, through such at least one enclosure wall, from the at least one contaminable mine area to the at least one mine refuge area within such at least one protective enclosure. In addition, it provides such a mine emergency refuge system wherein such at least one protective enclosure comprises: at least one life-support subsystem structured and arranged to provide life-support to the one or more mine personnel during the period of mine contamination in the mine emergency; wherein such at least one life-support subsystem comprises at least one oxygen maintainer structured and arranged to maintain, within such at least one protective enclosure, at least one breathable atmosphere comprising at least one life-sustaining level of oxygen; and at least one toxic-compound remover structured and arranged to remove at least one toxic compound from the at least one breathable atmosphere. And, it provides such a mine emergency refuge system wherein: such at least one enclosure wall structured and arranged to withstand about 15 pounds per square inch (psi) overpressure for about 0.2 seconds; and such at least one enclosure wall is structured and arranged to withstand exposure to a temperature of about 300-degrees Fahrenheit for about 3 seconds.

In accordance with another preferred embodiment hereof, this invention provides a system, relating to reducing contamination potential in a first area adjacent to a contaminated second area while permitting passage of at least one object from the contaminated second area to the first area, comprising: separator means for separating the first area from the contaminated second area; wherein such separator means comprises; deformable-passage means for deforming such separator means sufficiently to permit passing the at least one object through the separator means, and deformation-correction means for correcting such deforming sufficiently to restore the separating of such separator means; wherein such separator means comprises sufficient-fluid containment means for providing sufficient-fluid containing to assist such deformable-passage means and such deformation-correction means; and wherein such system provides such reducing contamination potential in the first area adjacent to the contaminated second area while permitting passage of the at least one object from the contaminated second area to the first area. Further, it provides such a system further comprising mine emergency refuge means for providing a protective enclosure as a refuge for mining personnel during a period of mine contamination in a mine emergency.

In accordance with another preferred embodiment hereof, this invention provides a system relating to reducing cross contamination during passage of at least one person or object through a passageway extending between an enclosable life-supporting refuge and least one contaminated environment, such system comprising: at least one air-inflatable separator to separate the enclosable life-supporting refuge and the least one contaminated environment; wherein such at least one air-inflatable separator comprises at least one air-inflatable tube having at least one flexible outer wall; wherein such at least one air-inflatable tube, when inflated, is structured and arranged to be sufficiently deformable during application of at least one manually-applied load to form at least one passageway to permit passing the at least one person or object through such at least one air inflatable separator; wherein such at least one air inflatable tube, when inflated, comprises at least one deformation corrector to correct such deformation sufficiently to restore the separating of such at least one air inflatable separator; wherein at least one portion of such at least one flexible outer wall comprises at least one air-permeable material to permit permeation of air from an interior of such at least one air inflatable tube through such at least one portion of such at least one flexible outer wall; and wherein such at least one air-inflatable separator, when inflated, provides reduced contamination potential in the enclosable life-supporting refuge while permitting passage of the at least one person or object from the least one contaminated environment to the enclosable life-supporting refuge. Even further, it provides such a system wherein such at least one flexible outer wall further comprises a plurality of air-venting apertures structured and arranged to vent the inflation air from the interior of such at least one air inflatable tube through such at least one flexible outer wall. In accordance with preferred embodiments hereof, this invention provides each and every novel feature, element, combination, step and/or method disclosed or suggested by this provisional patent application.

DETAILED DESCRIPTION OF THE BEST MODES AND PREFERRED EMBODIMENTS OF THE INVENTION

Figure 1:
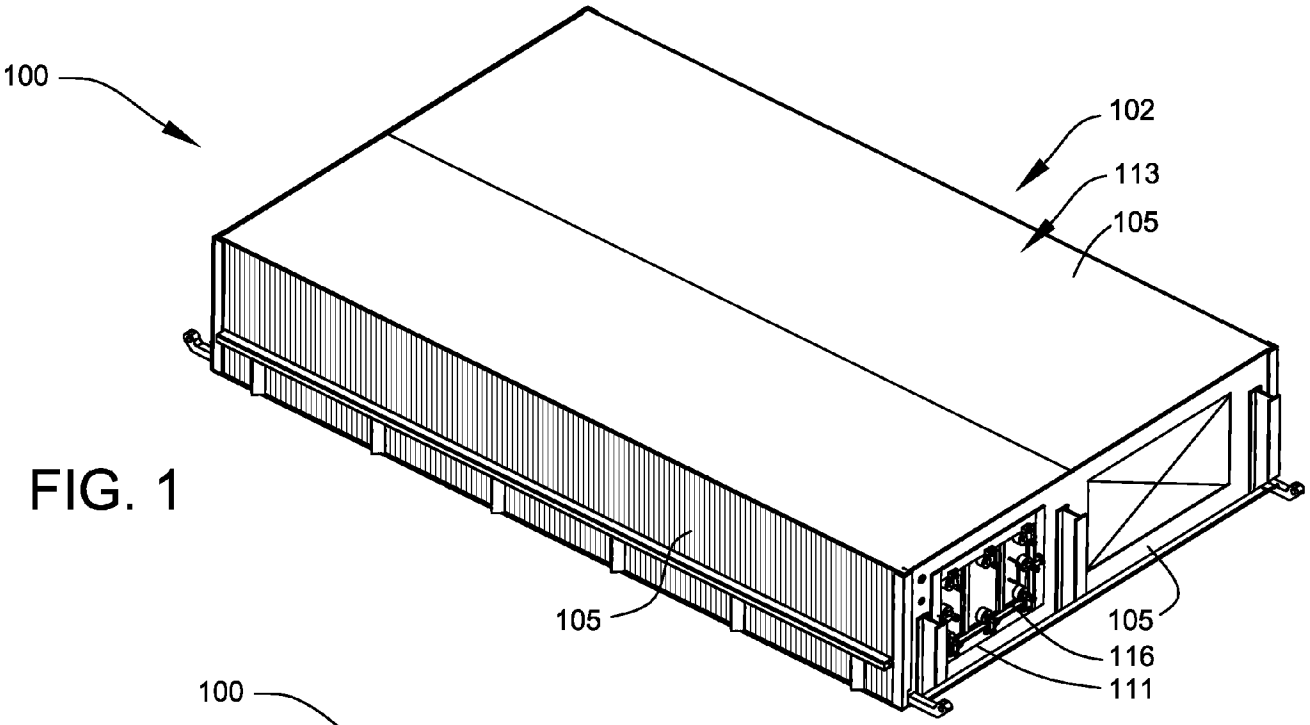
FIG. 1 shows a perspective view, illustrating a self-contained emergency refuge, according to a preferred embodiment of the present invention.
Figure 2:
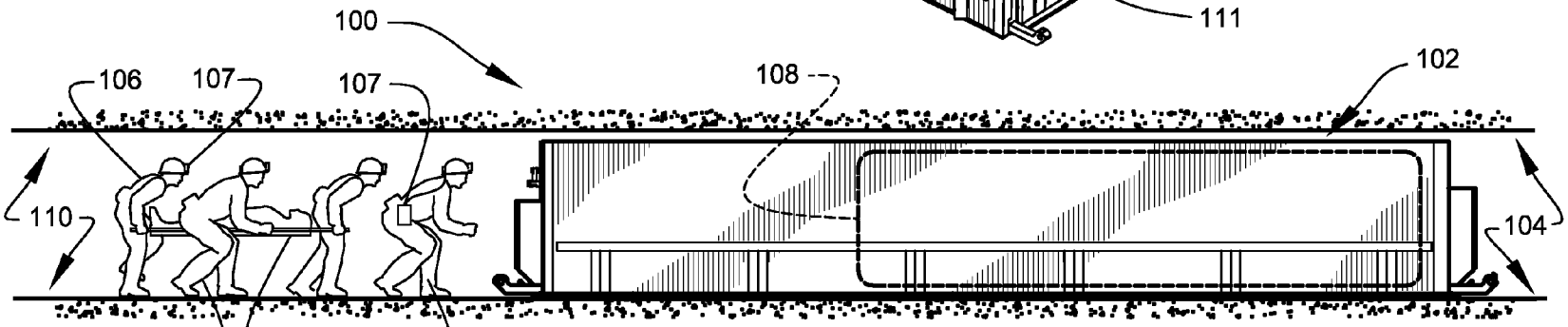
FIG. 2 shows a side view, illustrating the emergency refuge of FIG. 1, situated within an underground mine.

FIG. 1 shows a perspective view, illustrating a self-contained emergency refuge 102, according to a preferred embodiment of the present invention. FIG. 2 shows a side view, illustrating emergency refuge 102 of FIG. 1, situated within an area of hazardous contamination.

Described herein is an emergency refuge system 100, comprising emergency refuges 102 that are preferably designed to be deployed within areas having a high potential of hazardous contamination. Each embodiment is preferably configured to reduce contamination potential within a protected area within the refuge (at least embodying herein a first area), when the refuge is located adjacent a second area containing hazardous contamination, while permitting passage of persons and objects from the second area to the protected area within the refuge (at least embodying herein a system, relating to reducing contamination potential in a first area adjacent to a second area, which is potentially contaminable, while permitting passage of at least one object from the second area to the first area). Emergency refuge 102 is preferably configured to provide a protected, secure space enclosing a life-sustaining environment for persons temporarily trapped within the contaminated second area (at least embodying herein at least one life-supporting enclosure structured and arranged to enclose such first area).

Highly preferred embodiments of emergency refuge system 100 include emergency refuges 102 designed to be deployed in an underground mine 104, for use by underground mine personnel 106 during mine emergencies. These emergency refuges 102 are preferably configured to provide a protected, secure space enclosing at least one breathable atmosphere for one or more human occupants temporarily trapped within a mine (at least embodying herein wherein such at least one life-supporting enclosure comprises at least one mine emergency refuge structured and arranged to provide refuge for miners during a period of mine contamination in a mine emergency). The following embodiments of emergency refuge system 100 are preferably configured to serve the coal mining industry; however, it is important to note that the present technology can be implemented to protect individuals in other hazardous environments. For example, preferred embodiments of the present system may be deployed in above-ground environments where the release of hazardous materials is possible and where evacuation of individuals from the area of contamination may not be immediately safe or possible. Such environments may include industrial sites involving hazardous material production, sites operating under the threat of chemical or biological attacks, etc.

FIG. 2 depicts a group of mine personnel 106 approaching emergency refuge 102 during a mine emergency. Emergency refuge 102 is shown situated within a working section of underground mine 104. The refuge is preferably located a pre-determined distance away from the working face but sufficiently close to be readily accessible to mine personnel 106 during the emergency event. It is noted that multiple emergency refuges 102 may be pre-located within a mine section to accommodate all mine personnel 106 working the section, or to limit the required distance of travel to the refuge.

The depicted mine personnel 106 may include crew working a room or section and other persons who routinely work near the section, such as managers, surveyors, state and Federal inspectors, etc. The depicted crewmembers are outfitted in a manner consistent with normal mine operations and carry various customary items of equipment 107, which may include helmets, lights, hand-held radios, personal self rescuers, etc. In certain emergency situations, a team of mine personnel 106 may transport incapacitated individuals to emergency refuge 102 using stretcher 109, as shown. A principal objective of the system embodiments is to rapidly evacuate mine personnel 106 from the contaminated environment 110 of underground mine 104 (embodying herein the second area) to the habitable internal environment 108 within emergency refuge 102 (embodying herein the first area and embodying herein the at least one adjacent mine refuge area).

Figure 3:
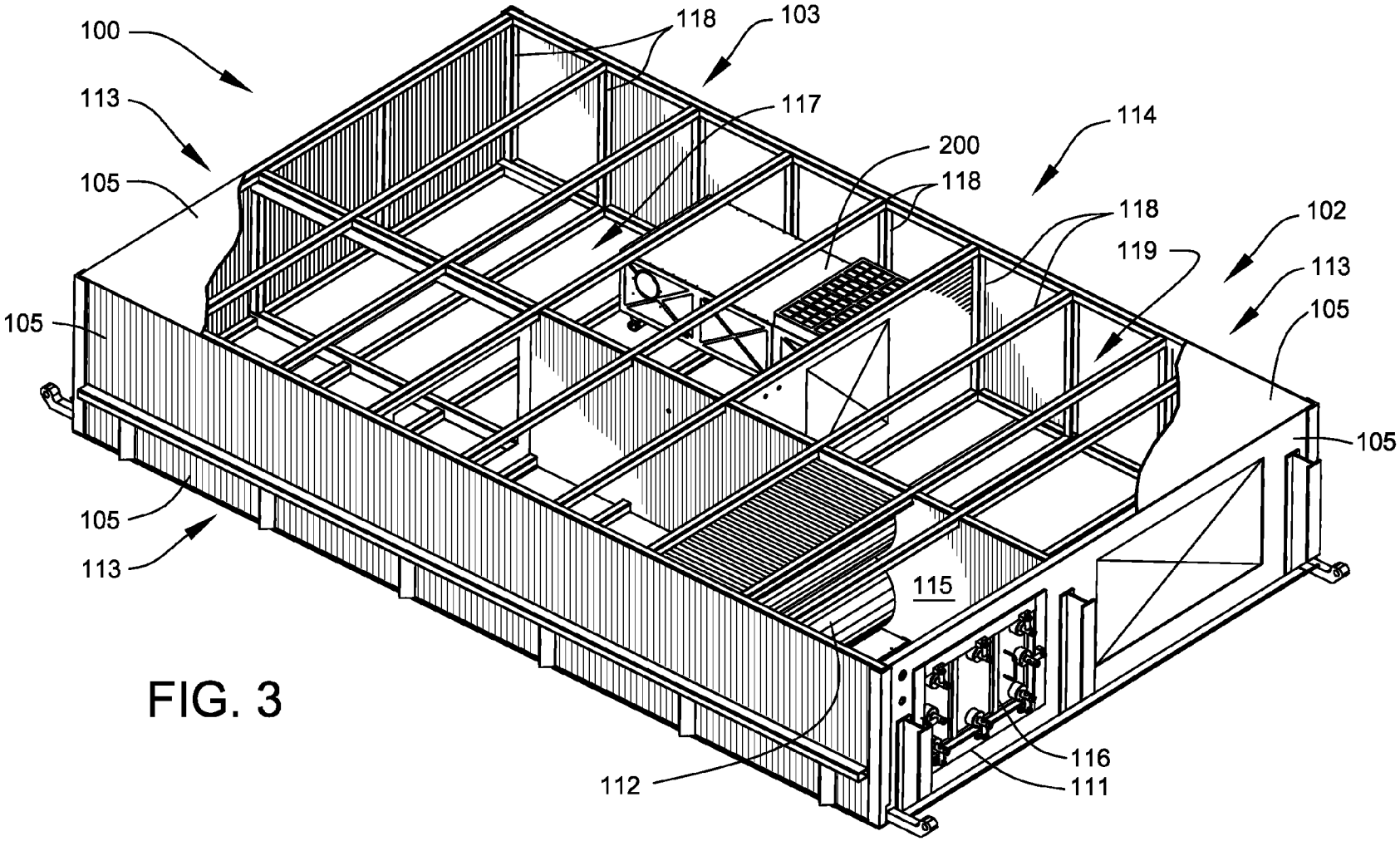
FIG. 3 shows a perspective view, in partial cut-away section, diagrammatically illustrating the emergency refuge of FIG. 1.
Figure 4:
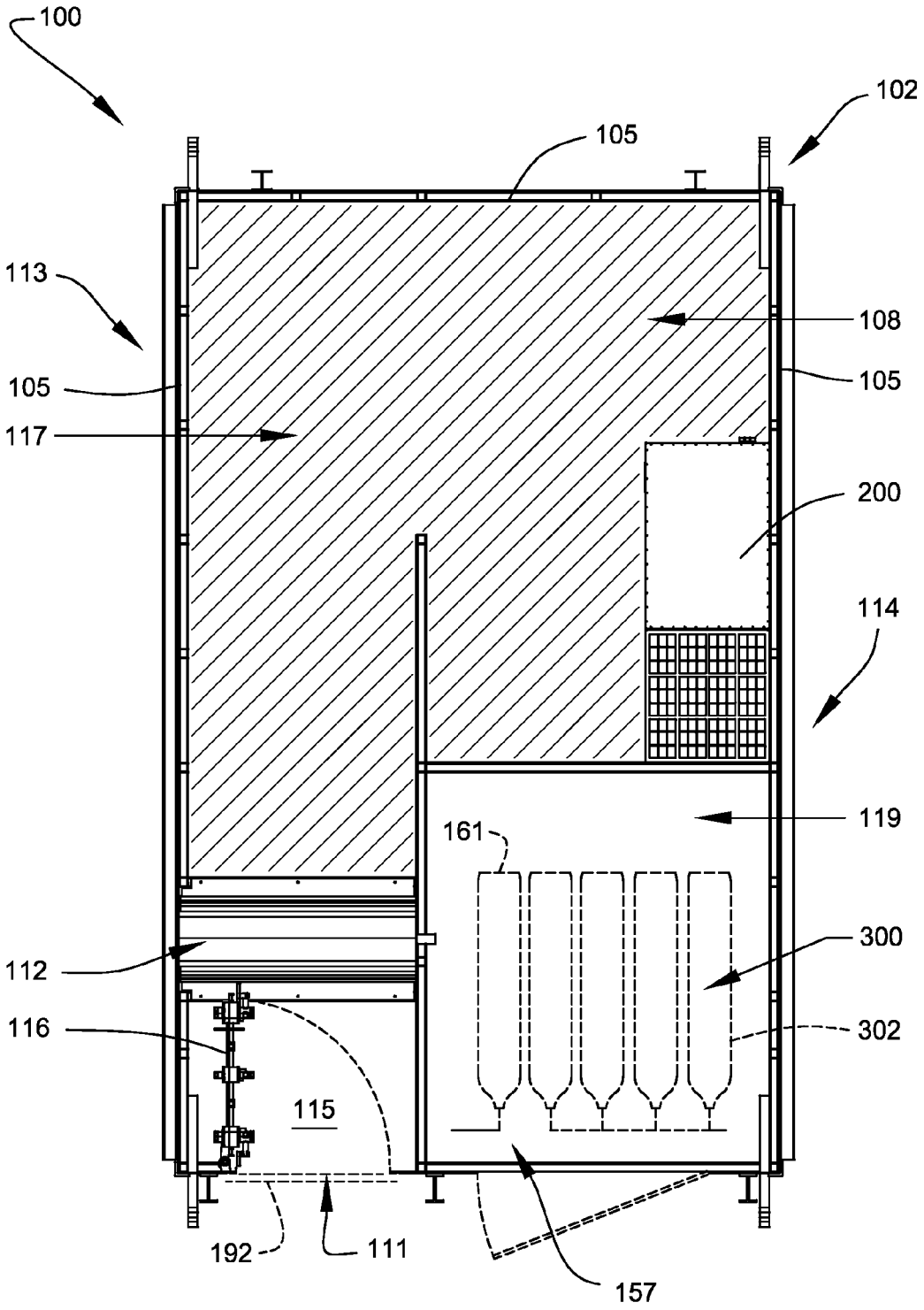
FIG. 4 shows a diagrammatic plan view showing the principal internal spaces of the emergency refuge of FIG. 1.

FIG. 3 shows a perspective view, in partial cut-away section, diagrammatically illustrating preferred internal arrangements of emergency refuge 102 of FIG. 1. FIG. 4 shows a diagrammatic plan view showing the principal internal spaces of emergency refuge 102 of FIG. 1.

Mine emergency refuge 102 is preferably configured to enclose a habitable internal environment 108 for one or more human occupants. Mine emergency refuge 102 preferably comprises an enclosable chamber 103 configured to protectively enclose one or more mine personnel during a period of mine contamination in a mine emergency (at least embodying herein at least one protective enclosure). Enclosable chamber 103 is preferably defined by a continuous separation boundary 113, as shown. Separation boundary 113 is preferably configured to isolate habitable internal environment 108 from the surrounding contaminated environment 110 of the mine.

Separation boundary 113 is preferably defined by a set of rigid outer walls 105 (at least embodying herein wherein such at least one life-supporting enclosure comprises at least one enclosure wall structured and arranged to enclose, within such first area, at least one breathable atmosphere for one or more human occupants). Outer walls 105 are preferably fabricated from a rigid material that has sufficient durability to withstand routine handling and resist puncture and tearing during deployment and use. Outer walls 105 are preferably constructed from at least one non-flammable material, preferably a metallic material, with steel being most preferred.

Outer walls 105 are preferably reinforced by an arrangement of internal structural members 118, as shown. The primary structural members 118 comprise rigid steel members assembled by thermal welding. The reinforced outer walls 105 are preferably designed to withstand overpressures resulting from a methane or coal dust explosion. In the present disclosure, overpressure is defined as the highest pressure over the background atmospheric pressure that results from an explosion, which includes the resulting pressure waves impacting outer walls 105. Outer walls 105 are preferably designed to withstand at least about 15 pounds per square inch (about 103 kilopascals) overpressure for at least about 0.2 seconds without allowing gases to pass through outer walls 105. In addition, outer walls 105 are preferably structured and arranged to withstand exposure to a flash-fire temperature of at least about 300-degrees Fahrenheit (about 149-degrees Celsius) for at least about 3 seconds. Preferred enclosable chambers 103, suitable for developing mine emergency refuge 102, include the Guardian line of refuge chambers produced by Mine Shield, LLC Lancaster, Ky. Upon reading this specification, those with ordinary skill in the art will now appreciate that, under appropriate circumstances, considering such issues as design preference, user preferences, marketing preferences, cost, structural requirements, available materials, technological advances, etc., other enclosure arrangements such as, for example, enclosures designed for alternate hazardous conditions, greater or lower blast overpressures, greater or lower flash temperatures, etc., may suffice.

Referring to the plan view of FIG. 4, the interior of mine emergency refuge 102 is preferably subdivided into two principal spaces. The first internal space, identified herein as occupant enclosure 117, preferably encloses habitable internal environment 108 (embodying herein the first space) and preferably functions as a life-supporting space for mine personnel 106 during an emergency event. Occupant enclosure 117, graphically identified in FIG. 4 by the region of diagonal hatching, is preferably equipped with essential items including, food and water rations, first aid provisions for emergency care, repair provisions enabling maintenance of internal equipment, a chemical toilet, communication equipment, gas monitoring equipment, and at least one life-support subsystem 114 to provide life-support to the mine personnel within occupant enclosure 117. Life-support subsystem 114 preferably provides an onboard oxygen distribution subsystem 300 and at least one air revitalization unit 200. Both oxygen distribution subsystem 300 and air revitalization unit 200 preferably function to maintain habitable internal environment 108 with a breathable atmosphere for preferably up to (at least) about 96 hours of entrapment (or greater). Oxygen distribution subsystem 300 is preferably designed to assist the delivery of safe concentrations of oxygen to occupant enclosure 117 (see also FIG. 31). Air revitalization unit 200 preferably maintains the atmosphere of (at least human) habitable internal environment 108 in a breathable condition by the removal of toxic compounds and trace contaminants that pose a hazard to the occupants (at least embodying herein at least one life-support unit comprising at least one toxic-compound remover structured and arranged to remove at least one toxic compound from the at least one breathable atmosphere).

Preferably, occupant enclosure 117 is further subdivided to form an entry and exit passageway 115, as shown. Passageway 115 is preferably configured to permit rapid transfer of mine personnel 106 through separation boundary 113 between uncontrolled external environment 110 and habitable internal environment 108. Access through separation boundary 113 to passageway 115 is preferably provided at entrance opening 111, which preferably extends through outer wall 105 adjacent passageway 115, as shown.

Passageway 115 is preferably configured to minimize transfer of contaminates, such as harmful particles and hazardous gases, between uncontrolled external environment 110 and habitable internal environment 108. Passageway 115 is preferably fitted with multiple separation structures, each one functioning to separate the uncontrolled external environment 110 and habitable internal environment 108, while allowing passage of mine personnel 106 between the two areas. Passageway 115 preferably comprises at least two contamination separators in the form of a specialized dynamic separation barrier 112 (at least embodying herein at least one first separator and at least embodying herein separator means for separating the first area from the contaminated second area) and an outer sealable cover hatch 116 fitted over entrance opening 111 (at least embodying herein at least one second separator and at least embodying herein separator means for separating the first area from the contaminated second area), as shown. Upon reading this specification, those with ordinary skill in the art will now appreciate that, under appropriate circumstances, considering such issues as design preference, user preferences, marketing preferences, cost, structural requirements, available materials, technological advances, etc., other contamination separators arrangements such as, for example, more than two separators, multiple hatches, multiple barriers, other covers, etc., may suffice.

Cover hatch 116 is preferably configured to sealably cover entrance opening 111, as shown. Cover hatch 116 is preferably configurable between at least one closed position (see FIG. 3 and FIG. 5) and at least one open position (see FIG. 4). When configured in the open position, cover hatch 116 allows mine personnel 106 to pass through entrance opening 111 to passageway 115. When configured the closed position, cover hatch 116 prevents movement of air and airborne containments through entrance opening 111.

The second principal space defined within the interior of mine emergency refuge 102 is mechanical room 119, which preferably functions to house and protect subsystems necessary for survival in the chamber. Systems components at least partially housed within mechanical room 119 include air and oxygen cylinders 302 of oxygen distribution subsystem 300 and compressed air tanks 161 of bladder-inflation subsystem 157. In the present preferred arrangements of mine emergency refuge 102, the atmosphere of mechanical room 119 remains unconditioned and is therefore separated from habitable internal environment 108 of occupant enclosure 117.

During an ingress procedure, dynamic separation barrier 112 of passageway 115 is preferably activated allowing mine personnel 106 to unseal and open the outer cover hatch 116 to expose passageway 115. In a preferred arrangement of the system, activation of dynamic separation barrier 112 is automatically triggered by the opening of outer cover hatch 116. Toxic gas, smoke, or dust entering passageway 115, from uncontrolled external environment 110, preferably is blocked from entering habitable internal environment 108 by the presence of the operating dynamic separation barrier 112.

Figure 7:
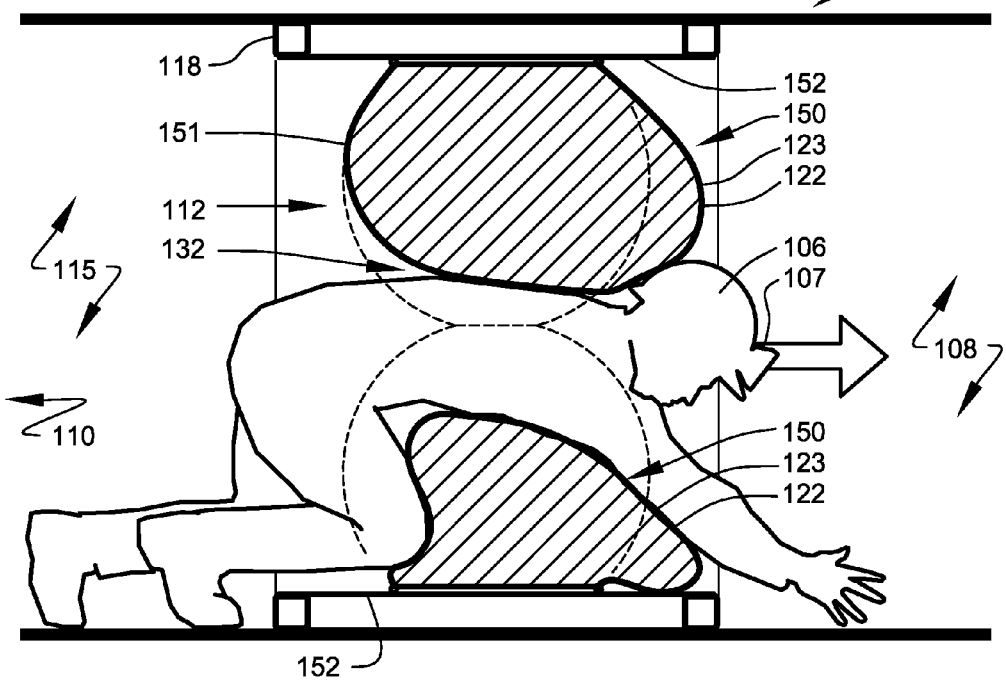
FIG. 7 shows a sectional side view, diagrammatically illustrating a miner entering the isolated environment from the contaminated environment by passing through the dynamic isolation barrier of FIG. 6.

Mine personnel 106 preferably enter into habitable internal environment 108 of mine emergency refuge 102 by passing through a deformable material of dynamic separation barrier 112 (as illustrated in FIG. 7). In preferred operation, the last mine personnel 106 entering passageway 115 closes and seals cover hatch 116 before moving through dynamic separation barrier 112 into habitable internal environment 108.

The volume of passageway 115 between entrance opening 111 and dynamic separation barrier 112 is preferably reduced to the minimum size necessary to accommodate both the inward swing of cover hatch 116 and the length of a single stretcher 109 supported by mine personnel 106. During initial activation and entry, dynamic separation barrier 112 preferably occupies a portion of the volume of passageway 115. Thus, the effective volume of passageway 115 exposed to contamination from uncontrolled external environment 110 is largely minimized. This preferred arrangement greatly reduces the amount of contamination potentially transferable to habitable internal environment 108 once entrance opening 111 is sealed and dynamic separation barrier 112 is deactivated. Furthermore, alternate preferred embodiments of emergency refuge 102 implement a means for purging air from the volume of passageway 115 located between entrance opening 111 and dynamic separation barrier 112, as presented in a later section of the present disclosure.

Figure 5:
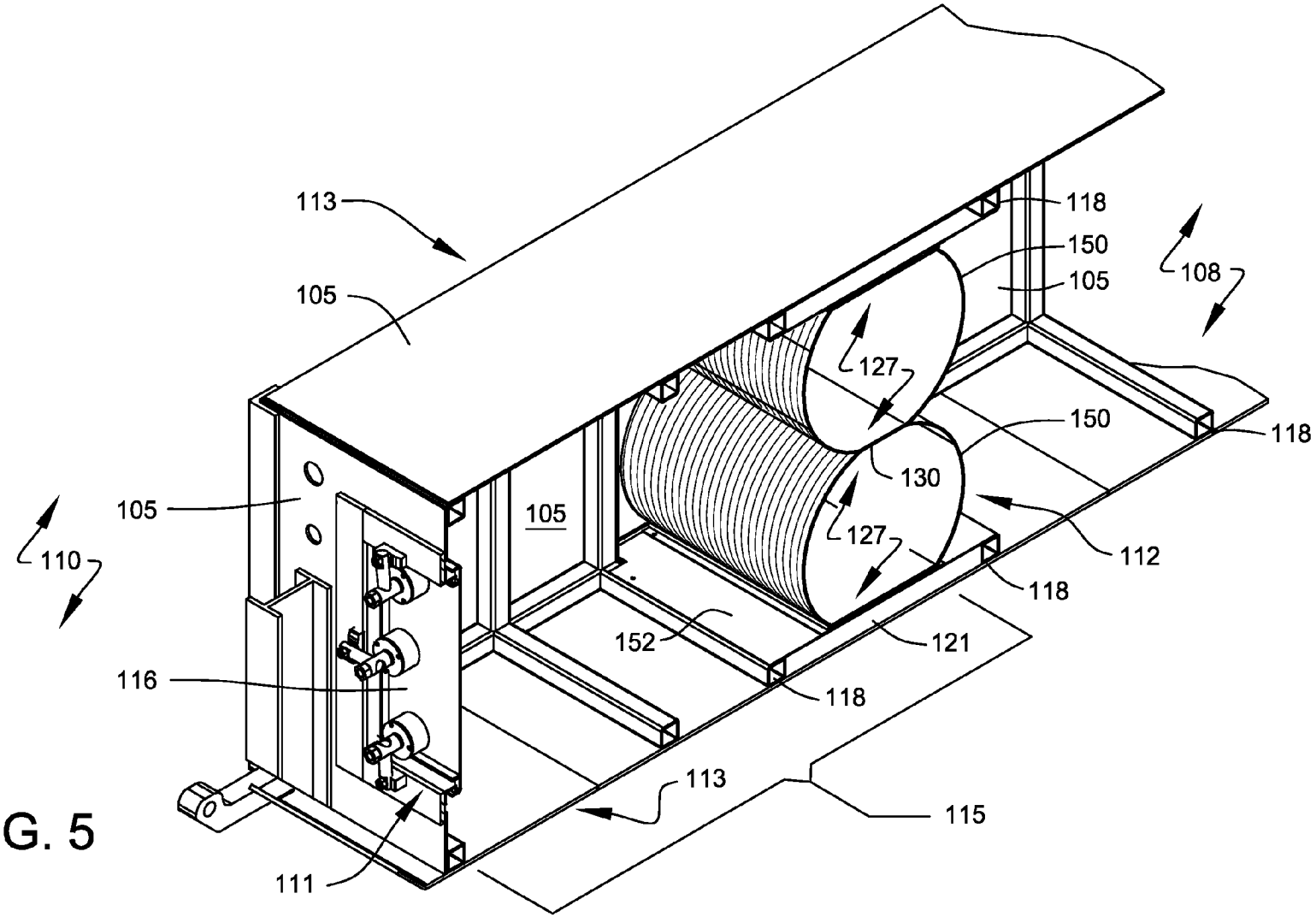
FIG. 5 shows a partial cut-away perspective view, illustrating an access passageway of the emergency refuge, according to the preferred embodiment of FIG. 1.
Figure 6:
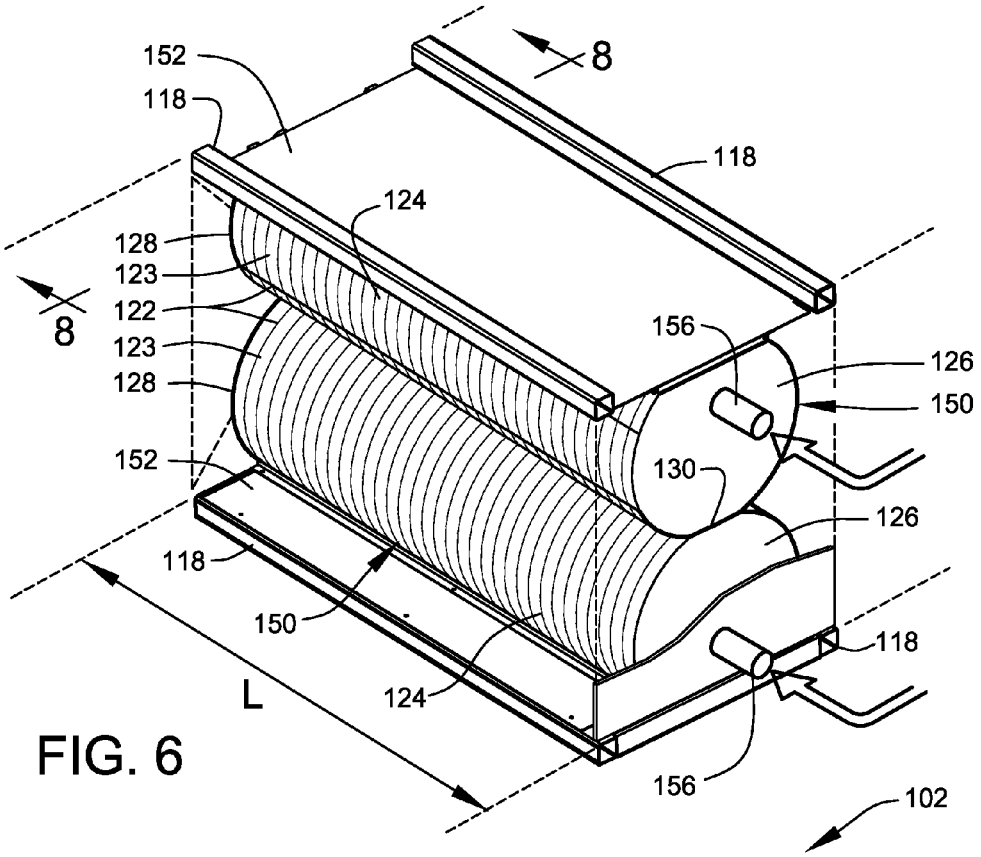
FIG. 6 shows a perspective view, illustrating a dynamic isolation barrier of the access passageway, according to the preferred embodiment of the present invention.

FIG. 5 shows a partial cut-away perspective view, illustrating outer cover hatch 116, passageway 115, and dynamic separation barrier 112 of the emergency refuge 102. FIG. 6 shows a perspective view, illustrating dynamic separation barrier 112 of access passageway 115, according to the preferred embodiment of the present invention.

Dynamic separation barrier 112 (embodying herein such at least one first separator) preferably comprises at least one elastic body 150 (hereinafter sometimes referred to as either "elastic body 150" or "elastic bodies 150"). Elastic body 150 preferably consists of substantially-enclosed fluid-inflatable bladder 123, as shown. Fluid-inflatable bladder 123 preferably comprises at least one continuous bladder wall 124 structured and arranged to contain at least one inflation fluid. Preferred inflation fluids include at least one gas, most preferably at least one breathable gas mixture (hereinafter sometimes referred to as "inflation air", "inflation gas", or simply "air"). Upon reading this specification, those with ordinary skill in the art will now appreciate that, under appropriate circumstances, considering such issues as design preference, user preferences, marketing preferences, cost, structural requirements, available materials, technological advances, etc., other elastic-body arrangements such as, for example, resilient-foam-filled bodies, etc., may suffice.

When inflated, fluid-inflatable bladder 123 preferably comprises a tubular shape, of substantially uniform cross section, having a lateral length L extending between first end closure 126 and second end closure 128, as shown. Each fluid-inflatable bladder 123 is preferably inflated by air pressure introduced into interior chamber 127 of the bladder at supply air inlet 156 (hereinafter referred to as "supply air inlet 156") preferably located at an end closure, as shown.

In a preferred arrangement of the present system, dynamic separation barrier 112 comprises two fluid-inflatable bladders 123 mounted in a stacked configuration within passageway 115, as shown. In this preferred arrangement, dynamic separation barrier 112 comprises an upper fluid-inflatable bladder 123 and a lower fluid-inflatable bladder 123, as shown. Each fluid-inflatable bladder 123 preferably comprises similar tubular shapes, each having a lateral length L extending between respective first end closures 126 and second end closures 128 (at least embodying herein wherein each one of such at least two fluid-inflatable bladders 123 comprise a tubular shape having a lateral length extending between at least one first end closure and at least one second end closure).

At least one of the two elastic bodies 150 preferably comprises a deformable separator region 122 preferably configured to deform under force loads applied to elastic body 150 by a person or object in contact with the deformable structures of the apparatus. Such deformable separator region 122 is preferably implemented by constructing portions of bladder wall 124 from at least one flexible material 151, such as a pliable fabric. Preferably, the bladder walls 124 of both elastic bodies 150 are constructed from flexible materials 151 and thus both elastic bodies 150 preferably comprise deformable separator regions 122 (at least embodying herein wherein such at least one upper fluid-inflatable bladder comprises at least one upper deformable separator region and such at least one lower fluid-inflatable bladder comprises at least one lower deformable separator region).

FIG. 7 shows a sectional side view, diagrammatically illustrating mine personnel 106 entering habitable internal environment 108 by passing through dynamic separation barrier 112 of FIG. 6. Both the upper and lower elastic bodies 150 of dynamic separation barrier 112 are illustrated in an operable (inflated) state. Persons and objects moving through dynamic separation barrier 112 deform elastic bodies 150 from their resting inflated configuration. Sufficient distortion results in the separation of the upper and lower elastic bodies 150 creating at least one dynamic passage 132 through which mine personnel 106 and/or objects pass (at least embodying herein deformable-passage means for deforming such separator means sufficiently to permit passing the at least one object through the separator means). The dynamic passage 132 is preferably generated in response to force loads applied to either one or both of the elastic bodies 150 (at least embodying herein wherein such at least one passageway through such at least one first separator is formable by sufficient deformation of either one of such at least one upper deformable separator region and such at least one lower deformable separator region). In the present example, force loads are shown applied to both the upper and lower elastic bodies 150 by contact of mine personnel 106 with the flexible walls of the apparatus.

When inflated, bladder walls 124 of both elastic bodies 150 dynamically conform to the shape of mine personnel 106 as mine personnel 106 passes through, even while mine personnel 106 carries items of equipment 107, as shown. Fluid pressure within elastic body 150 presses the flexible material 151 against the person or objects to minimize air leakage between elastic bodies 150 and the person or objects moving through the barrier. Thus, dynamic separation barrier 112 preferably provides for mine personnel 106 to penetrate dynamic separation barrier 112 while maintaining a high level of physical separation between uncontrolled external environment 110 and habitable internal environment 108.

In the absence of the force loads, the same fluid pressure that conforms the elastic bodies 150 to the shape of mine personnel 106 preferably functions to return dynamic separation barrier 112 to a resting configuration, with both elastic bodies 150 preferably restored to their original shape geometry. Thus, fluid pressure within elastic bodies 150 preferably functions as a means for sufficiently correcting deformation in elastic bodies 150 so that the separating function of dynamic separation barrier 112 is restores and/or maintained (at least embodying herein at least one deformation corrector structured and arranged to correct such deformation sufficiently to restore the separating of such at least one first separator and at least embodying herein deformation-correction means for correcting such deforming sufficiently to restore the separating of such separator means and at least embodying herein wherein such separator means comprises sufficient-fluid containment means for providing sufficient-fluid containing to assist such deformable-passage means and such deformation-correction means).

Figure 8:
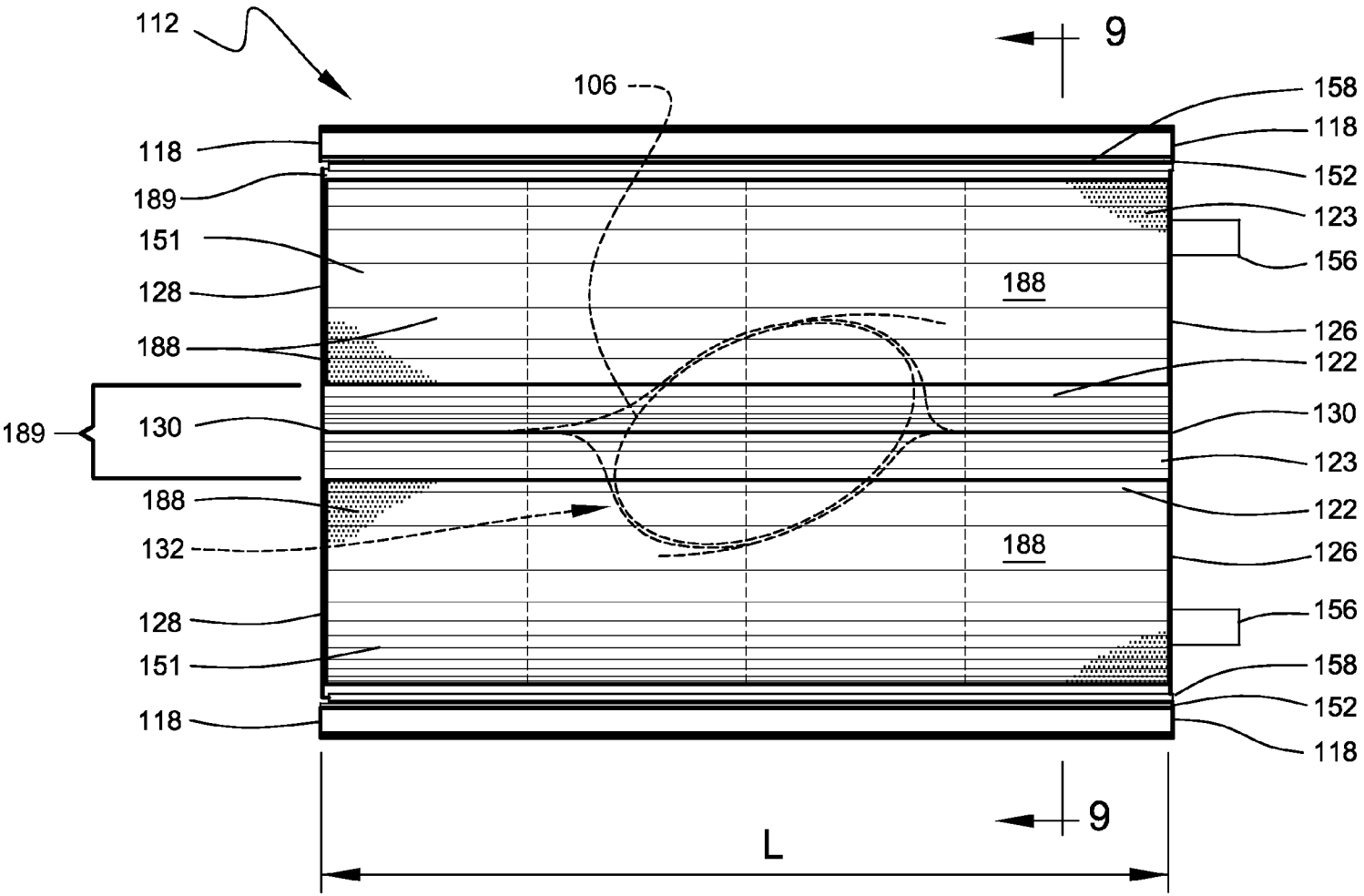
FIG. 8 shows an elevation view, illustrating the dynamic isolation barrier, according to the preferred embodiment of FIG. 1.
Figure 9:
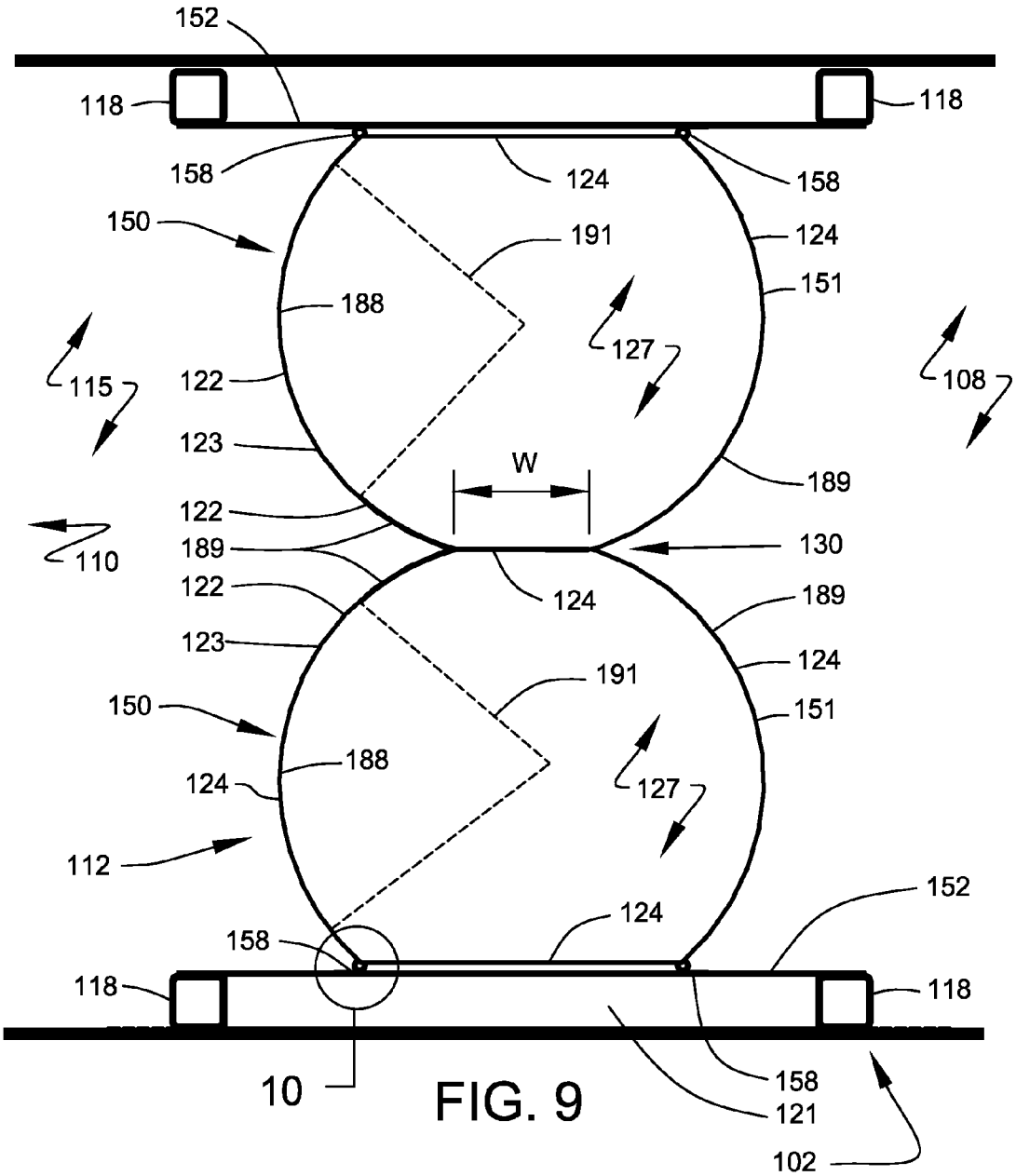
FIG. 9 shows a sectional view, taken through the section 9-9 of FIG. 8, illustrating the dynamic isolation barrier creating a self-closing seal, according to the preferred embodiment of FIG. 1.

FIG. 8 shows an elevation view, further illustrating the preferred arrangements of dynamic separation barrier 112. FIG. 9 shows a sectional view, taken through the section 9-9 of FIG. 8, illustrating dynamic separation barrier 112 and a self-closing passage seal 130 formed between the upper and lower elastic bodies 150 during active operation.

Preferably, both the upper and lower elastic bodies 150 are mounted within passageway 115 in a manner placing their respective deformable separator regions 122 in separable contact during operation (at least embodying herein wherein such at least one upper deformable separator region is arranged to be in separable contact with such at least one lower deformable separator region). The linear region of contact between deformable separator region 122 of the upper elastic body 150 and deformable separator region 122 of the lower elastic body 150 preferably forms a releasable seal 130 configured to seal the region of contact between the two elastic bodies 150. Seal 130 preferably functions to restrict the movement of potentially harmful gasses through dynamic separation barrier 112 between uncontrolled external environment 110 and habitable internal environment 108.

Seal 130 is preferably generated when the apparatus is in resting cooperation, wherein both elastic bodies 150 are restored to their original shape geometry. Seal 130 is preferably generated by contact between the deformable separator regions before and after the formation of a dynamic passage 132 between the two fluid-inflatable elastic bodies 150. (at least embodying herein wherein contact between such at least one upper deformable separator region and such at least one lower deformable separator region forms at least one releasable passage seal structured and arranged to releasably seal such at least one passageway formable between such at least two fluid-inflatable bladders). The preferred semi-circular cross sections of the elastic bodies 150 form a seal 130 having a continuous contact width W sufficient to restrict the migration of gasses across the resilient barrier in typical pressure environments. Upon reading this specification, those with ordinary skill in the art will now appreciate that, under appropriate circumstances, considering such issues as design preference, pressure differentials, structural requirements, selected materials, etc., other seal-forming tubular shapes such as, for example, triangular, rectangular, trapezoidal, elliptical, semi-circular, etc., may suffice.

The elevation view diagram of FIG. 8 further illustrates the preferred operation of dynamic separation barrier 112 when elastic bodies 150 are inflated. The dashed-line depiction of FIG. 8 shows the deflection and partial distortion of the upper and lower elastic bodies 150 as mine personnel 106 and/or objects pass through the separation barrier. The outer shape of the miner's body is diagrammatically illustrated by the semi-oval dashed-line boundary of FIG. 8.

Seal 130 preferably extends continuously along lateral length L and is preferably oriented in a substantially horizontal position, as shown. Seal 130 is preferably located at an elevation approximately halfway between the floor and ceiling of passageway 115. This preferred equidistant placement of the seal assists in excluding the passage of both lighter-than-air gasses (for example, methane) and heavy particles (coal dust) through the barrier. Upon reading this specification, those with ordinary skill in the art will now appreciate that, under appropriate circumstances, considering such issues as design preference, manufacturer preference, cost, changing needs, future technologies, etc., other types of elastic bodies, such as, for example, elastomer-type polymer bladders, solid or semi-solid elastomer-type polymer bodies, foam, sponge, etc., or combinations of such materials may suffice.

Preferably, bladder wall 124 of each elastic body 150 comprises ruggedized regions 189 and at least one porous air-diffusion panel 188, as shown. Ruggedized regions 189 of elastic body 150 are preferably designed resist tearing and abrasion damage during the passage of mine personnel 106 and equipment through the barrier. Ruggedized regions 189 are preferably located at mounting points between the fabric wall and adjacent support structures and in areas of the bladder walls 124 having a greater likelihood of physically contacting mine personnel 106 and objects passing through the barrier. This preferably includes the deformable separator regions 122 of the upper and lower elastic bodies 150 adjacent seal 130, as shown.

In a preferred embodiment of the present system, flexible material 151 of ruggedized regions 189 comprises at least one woven fabric having a non-porous polymer coating, preferably a contaminant-resistant coating, preferably a durable Polyvinyl chloride (PVC) coating, preferably a PVC fabric with a polyester scrim. A preferred flexible material suitable for use in ruggedized regions 189 includes a PVC coated plain weave polyester fabric having a weight greater than about 5 ounces per square yard (about 170 grams per meter square) produced by DuctSox Corporation of Milwaukee, Wis. under the trade name DuraTex™. Upon reading this specification, those with ordinary skill in the art will now appreciate that, under appropriate circumstances, considering such issues as design preference, user preferences, marketing preferences, cost, structural requirements, available materials, technological advances, etc., other flexible material arrangements such as, for example, composite fabrics, permeable and semi-permeable materials, alternate coating compositions, extruded or molded synthetic membranes, non-woven fabrics, etc., may suffice.

Air-diffusion panel 188 is preferably configured to permit permeation of inflation air from the interior of elastic bodies 150 through bladder wall 124 to the region of passageway 115 between dynamic separation barrier 112 and entrance opening 111 (at least embodying herein wherein at least one portion of such at least one flexible outer wall comprises at least one air-permeable material to permit permeation of air from an interior of such at least one air inflatable tube through such at least one portion of such at least one flexible outer wall). The preferred discharging of the inflation air into passageway 115 assists in sweeping contaminated gas out of passageway 115, which further reduces the amount of contaminated gas that is able to enter habitable internal environment 108.

Referring again to the elevation view of FIG. 8, air-diffusion panel 188 preferably extends substantially the full width length L of each elastic body 150, as indicated by the partially shaded regions of the illustration. Referring to in the sectional view of FIG. 9, the depicted circular sectors 191 of the illustration indicate the approximate preferred arc length of air-diffusion panels 188 along the face of the respective elastic bodies 150. Air-diffusion panels 188 preferably extend across a majority of the regions of bladder walls 124 in communication with passageway 115, as shown. It should be noted that the preferred area of each air-diffusion panel 188 is preferably selected, in part, based on the, inflation pressures, permeability of the selected fabric, volume of air needed to adequately purge the adjacent passageway, etc. Thus, the area of air-diffusion panel 188 may vary with the size and configuration of passageway 115 (see also FIG. 12E).

In a preferred embodiment of the present system, air-diffusion panels 188 are preferably constructed from a woven air-permeable fabric, preferably woven polyester, preferably a fire-retardant fabric. A preferred flexible material suitable for use as air-diffusion panels 188 includes a permeable woven polyester fabric, part number MBX062 produced by DuctSox Corporation of Milwaukee, Wis. under the trade name LabSox. Upon reading this specification, those with ordinary skill in the art will now appreciate that, under appropriate circumstances, considering such issues as design preference, user preferences, marketing preferences, cost, structural requirements, available materials, technological advances, etc., other flexible material arrangements such as, for example, permeable composite fabrics, perforated materials, coated compositions, non-woven fabrics, etc., may suffice.

Fluid-inflatable bladders 123 forming the elastic bodies 150 are preferably secured to upper and lower mounting panels 152 (hereinafter referred to as "mounting panels 152"), as shown. Mounting panels 152 preferably comprise a substantially rigid sheet material capable of supporting both static and dynamic loading associated with the operation of dynamic separation barrier 112. Preferably, mounting panels 152 are rigidly secured to the adjacent structural reinforcements 118 using mechanical fasteners or thermal welding.

Figure 10:
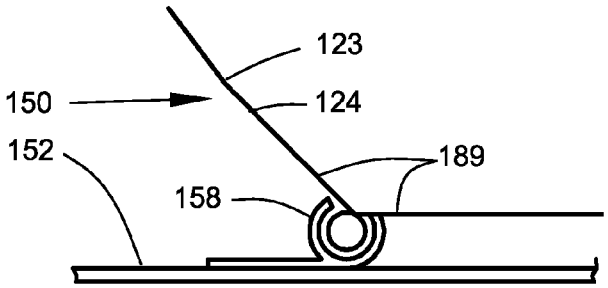
FIG. 10 shows a sectional view, magnified for clarity, of the sectional detail 10 of FIG. 9, illustrating preferred mounting arrangements of the dynamic isolation barrier to structures of the emergency refuge.

FIG. 10 shows a sectional view, magnified for clarity, of the sectional detail 10 of FIG. 9, further illustrating the preferred mounting arrangements of elastic bodies 150 to the adjacent mounting panels 152 using linear retention tracks 158. Preferably, elastic bodies 150 are attached to the supportive structures of emergency refuge 102 by sets of linear retention tracks 158 (hereinafter "retention tracks 158"). Retention tracks 158 are preferably configured to capture a portion of flexible material 151 forming the wall of elastic body 150. Retention tracks 158 preferably extend the length L of elastic bodies 150 and are preferably secured to mounting panels 152 (hereinafter "mounting panels 152"), which preferably fasten to internal structural members 118, as shown.

In the present embodiment, retention tracks 158 are preferably secured to mounting panels 152 using mechanical fasteners. Upon reading this specification, those with ordinary skill in the art will now appreciate that, under appropriate circumstances, considering such issues as design preference, manufacturer preference, cost, changing needs, future technologies, etc., other types of retention tracks or retention methods, such as, for example, rivets, bolts, screws, adhesives, sewn loops, straps, etc., may suffice.

At least one filler material 121 (preferably comprising resilient mats, foam, etc) is preferably installed below the lower mounting panel 152 to limit downward deflection of the panel under the weight of mine personnel 106 during ingress.

Figure 11:
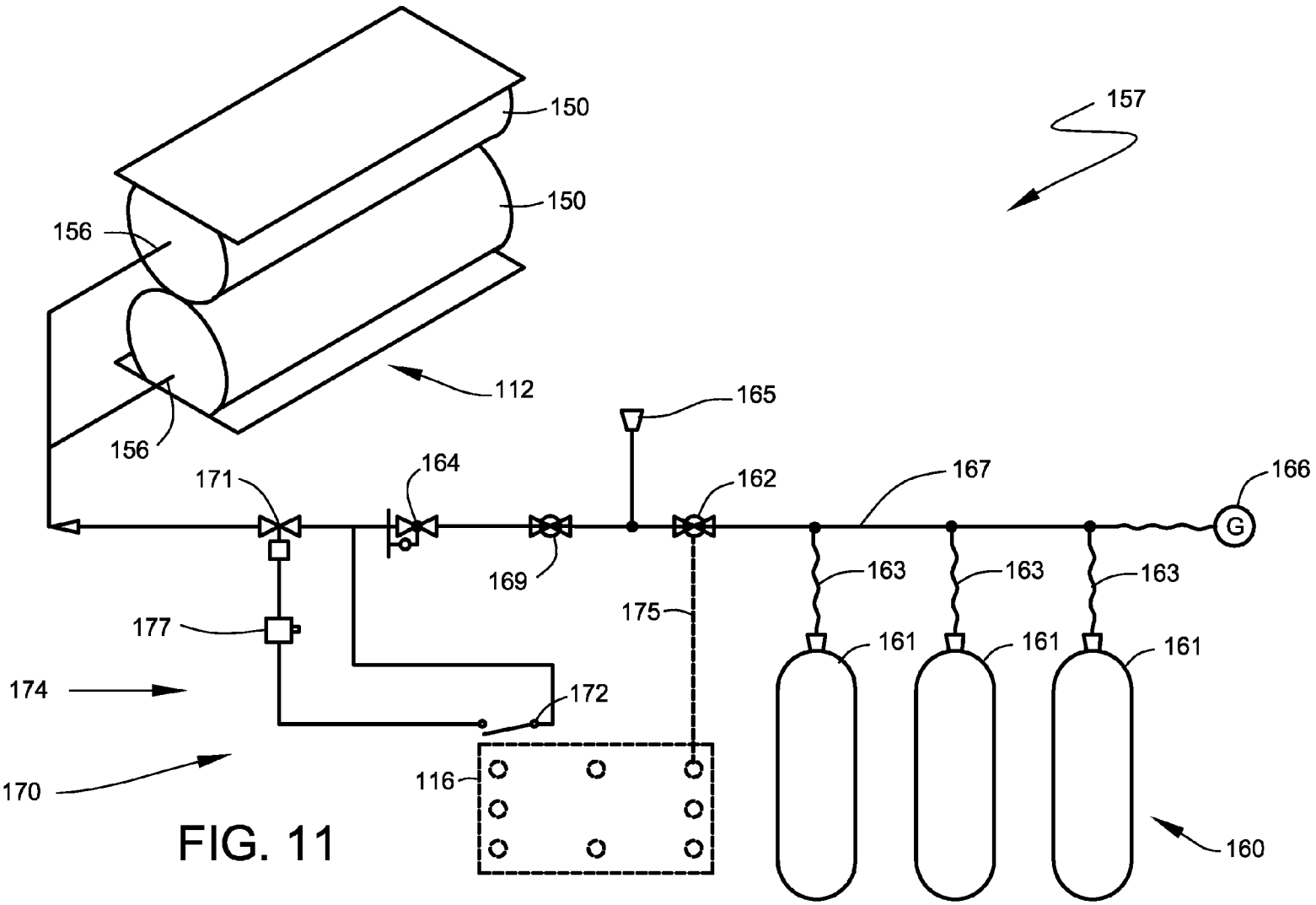
FIG. 11 shows a diagram showing an operable fluid source of the dynamic isolation barrier.

FIG. 11 is a diagram showing a preferred bladder-inflation subsystem 157 supporting the operation of dynamic separation barrier 112. Bladder-inflation subsystem 157 is preferably configured to inflate elastic bodies 150 using at least one inflation gas delivered to the supply air inlets 156 at dynamic separation barrier 112. Bladder-inflation subsystem 157 is preferably configured to inflate elastic bodies 150 using breathable air. Elastic bodies 150 are preferably pressurized with inflation air during initial activation of mine emergency refuge 102 and preferably remain continuously pressurized during ingress of mine personnel 106. Upon reading this specification, those with ordinary skill in the art will now appreciate that, under appropriate circumstances, considering such issues as design preference, manufacturer preference, cost, changing needs, future technologies, etc., other types of compressed air sources or inflation means, such as, for example, fans, blowers, thermal expansion means, etc., may suffice.

Bladder-inflation subsystem 157 preferably comprises at least one compressed air source 160 operably coupled to an arrangement of air-distribution components and air-flow controls. Preferred components include flexible hose connections 163, rigid manifold 167, pressure regulator 164, fill port 165, pressure gauge 166, isolator valve 169, and an inflation control subsystem 170.

Inflation control subsystem 170 is preferably configured to control delivery of breathable air to each such at least one fluid-inflatable bladder 123 of dynamic separation barrier 112. Inflation control subsystem 170 at least preferably comprises actuation valve 162, on/off valve 171, and air switch 172, and air-timer delay 177, as shown.

Compressed air source 160 preferably comprises one or more compressed air tanks 161, which are preferably located within mechanical room 119. Compressed air tanks 161 preferably comprise gas cylinders having an industry-standard size and pressure capacity. Compressed air tanks 161 preferably comprise internal volume of about 49 liters and a service pressure of about 2640 pounds per square inch gauge (about 186 kg/cm$^2$). Stainless steel adapters are preferably used, as required, to adapted the compressed air tanks 161 to flexible hose connections 163. Flexible hose connections 163 preferably conduct inflation air from the tanks to rigid manifold 167. Stainless steel Permalite™ Tee fittings, by Permaswage of Gardena, Calif., are preferably used to couple the flexible hose connections to the manifold.

Fill port 165 and isolator valve 169 are preferably incorporated within rigid manifold 167, as shown. Fill port 165 preferably comprises a Schrader-type fill valve used to charge compressed air tanks 161 with high-pressure inflation air prior to use. Isolator valve 169 is preferably closed during system charging to isolate and protect the downstream pneumatics. At least one pressure gauge 166 is preferably provided at rigid manifold 167 to allow for periodic pressure monitoring. This gauge is preferably configured to be visible from the outside of the refuge chamber.

Inflation control subsystem 170 preferably comprises at least one automatic trigger assembly 174 configured to automatically actuate the opening of actuation valve 162 when at least one trigger condition is achieved. Preferably, inflation control subsystem 170 is configured to automatically inflate elastic bodies 150 just prior to the entry of mine personnel 106 into passageway 115.

Preferably, actuation valve 162 is in a normally closed position. Trigger assembly 174 is preferably structured and arranged to open actuation valve 162 when at least one of the bolts securing cover hatch 116 is released (at least embodying herein wherein said at least one inflation controller comprises at least one trigger structured and arranged to trigger such inflation of said at least one fluid-inflatable bladder as said at least one cover hatch is unsealed). Hatch 116 is preferably held closed by eight manually-rotated internal dog legs with large hex interfaces on the exterior side (see FIG. 3). When a pre-selected hex is opened, an attached lanyard 175 is preferably configured to open actuation valve 162.

Inflation control subsystem 170 is preferably configured to initiate operation of the exclusion system any time hatch 116 is opened. Inflation control subsystem 170 is preferably further configured to detect if hatch 116 is in a closed position. When hatch 116 is closed, inflation control subsystem 170 is preferably configured to continue delivery of air to elastic bodies 150 for about 30 seconds. At the end of the 30-second duration, airflow to dynamic separation barrier 112 is shut off. This preferred delay allows inflation air exiting dynamic separation barrier 112 to continue to purge passageway 115 of contaminants after the hatch is shut (it should be noted that at least one positive pressure relief valve, in fluid communication with passageway 115, is preferably provided to prevent over pressurization of the enclosure after the hatch is closed).

Once actuation valve 162 is opened, inflation air flows through pressure regulator 164 and the normally open on/off valve 171 before reaching dynamic separation barrier 112, as shown. On/off valve 171 is preferably actuated by a pneumatic control circuit containing air switch 172, and air-timer delay 177, as shown. Air switch 172 is preferably mounted at hatch 116 and preferably comprises a heavy-duty camroller air valve with a plunger configured to depress when hatch 116 is closed. Closing hatch 116 depresses the plunger to open the valve, preferably sending a "hatch closed" air signal to on/off valve 171. Preferably, the "hatch closed" air signal is delayed for a pre-determined duration by the action of air-timer delay 177. Preferred duration of signal delay is about 30 seconds. When the air signal reaches on/off valve 171, the valve preferably closes and the flow of inflation air through dynamic separation barrier 112 is stopped. If hatch 116 is reopened, the pressurized air signal is preferably vented, opening on/off valve 171, and the flow of inflation air immediately is restarted.

Pressure regulator 164 preferably comprises a single-stage fixed-flow pressure regulator functioning to step down the air pressure from the maximum tank pressure of 2640 psi (about 186 kg/cm$^2$) to a preferred service pressure after actuation valve 162 has been activated. Pressure regulator 164 is preferably adjusted to maintain a constant flow rate of between about 30 and about 50 cubic feet per minute (between about 51 and 85 cubic meters per hour).

The above-described, bladder-inflation subsystem 157 automatically places dynamic separation barrier 112 in operation prior to hatch 116 being opened and automatically stops the flow of inflation air to dynamic separation barrier 112 shortly after hatch 116 is closed. Upon reading this specification, those with ordinary skill in the art will now appreciate that, under appropriate circumstances, considering such issues as design preference, user preferences, cost, structural requirements, available materials, technological advances, etc., other control arrangements such as, for example, manual inflation controls, processor-assisted logic/actuation, additional timers, remotely-operated triggers, altering operational performance based on gas availability, using proximity detectors, using multiple vales to separately inflate the elastic bodies, adding visual or audible alerts to indicate operational status, etc., may suffice.

Elastic bodies 150 of dynamic separation barrier 112 are preferably designed to inflate until the upper and lower elastic bodies 150 come into physical contact to create seal 130. Excess inflation air discharged through air-diffusion panels 188 is preferably used as a purge gas to purge passageway 115 of contaminants. During an ingress procedure, inflation air discharged through air-diffusion panels 188 preferably generates a positive atmospheric pressure within passageway 115 (relative to uncontrolled external environment 110). Preferably maintaining a small positive pressure of clean air inside the chamber assists in sweeping contaminated gas out of passageway 115, further reducing the amount of contaminated gas that is able to enter habitable internal environment 108 (at least embodying herein at least one airborne-contaminants purger structured and arranged to purge such at least one passageway of airborne contaminants). Upon reading this specification, those with ordinary skill in the art will now appreciate that, under appropriate circumstances, considering such issues as design preference, cost, structural requirements, passageway geometry, available materials, technological advances, etc., other purge ventilation arrangements such as, for example, using discrete vents to discharge breathable gas into the passage, using a rigid piped manifold (e.g., PVC) with multiple vents located on the inside of the passage walls, providing a set of small-diameter D-shaped inflatable structures (having multiple vents) located on the inside of the passage walls, etc., may suffice.

The preferred use of inflation air to sweep passageway 115 significantly reduces need for dedicated sources of purge gas during initial loading of mine personnel 106 into mine emergency refuge 102. Average gas flow rate during initial loading of mine personnel 106 into mine emergency refuge 102 is preferably expected to be less than about 10 standard cubic feet per minute (about 283 liters per minute). The described system is preferably capable of operating for about 20 minutes (to ingress up to about 16 occupants) using an amount of breathable air storable in about one compressed air tank 161 having an internal volume of about 49 liters and a service pressure of about 2640 pounds per square inch gauge (about 186 kg/cm$^2$). FIG. 12A through FIG. 12F illustrate alternate preferred configurations of elastic bodies 150 providing breathable purge gas to passageway 115.

Figure 12B:
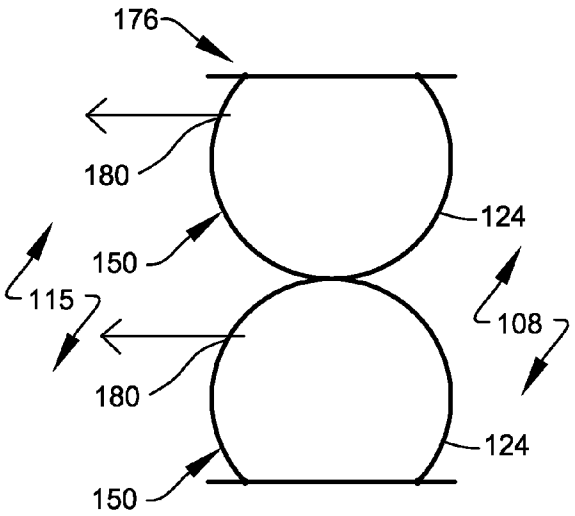
FIG. 12B shows a sectional view, diagrammatically illustrating air venting by the alternate dynamic barrier of FIG. 12A.
Figure 12D:
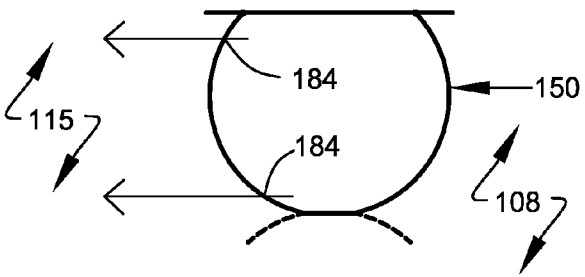
FIG. 12D shows a sectional view, diagrammatically illustrating air venting by the alternate dynamic barrier of FIG. 12C.
Figure 12A:
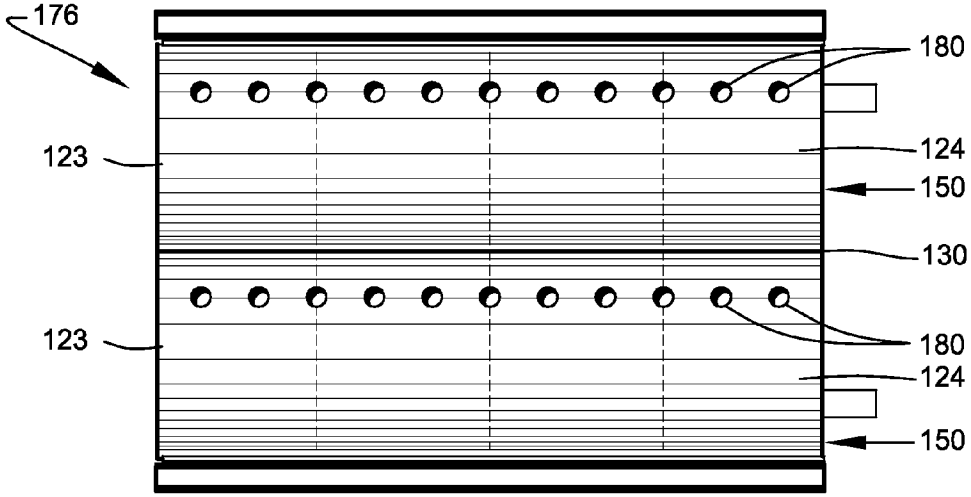
FIG. 12A shows an elevation view, showing an alternate dynamic barrier passageway, containing multiple sets of air vents, according to an alternate preferred embodiment of the present invention.

FIG. 12A shows an elevation view, showing an alternate dynamic barrier 176, containing multiple sets of air-venting apertures 180, according to an alternate preferred embodiment of the present invention. Preferably, bladder wall 124 of each elastic body 150 comprises a plurality of air-venting apertures 180, as shown. Air-venting apertures 180 are preferably configured to vent inflation air from the interior of elastic bodies 150 through bladder wall 124 to the region of passageway 115 between dynamic separation barrier 112 and entrance opening 111. FIG. 12B shows a sectional view, diagrammatically illustrating air venting by the alternate dynamic barrier 176 of FIG. 12A. The preferred venting of inflation air into passageway 115 is diagrammatically depicted by the dashed-line arrow depictions.

Alternate dynamic barrier 176 is preferably configurable to operate with a bladder wall 124 constructed from a non-permeable flexible material 151. This alternate preferred configuration allows development of elastic bodies 150 having large ruggedized regions 189; thus, alternate dynamic barrier 176 is especially useful in heavy use applications. Alternately preferably, bladder wall 124 can be constructed from a permeable flexible material 151.

Figure 12C:
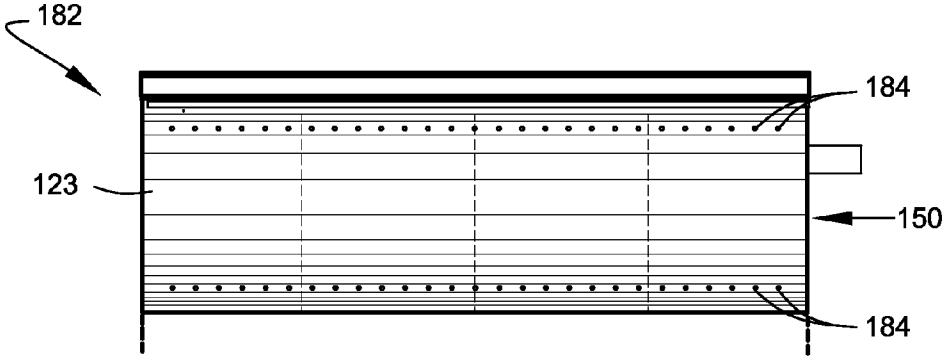
FIG. 12C shows an elevation view, showing an upper elastic body of an alternate dynamic barrier, containing multiple air-diffusion apertures, according to an alternate preferred embodiment of the present invention.

FIG. 12C shows an elevation view, showing an upper elastic body 150 of an alternate dynamic barrier 182, containing multiple air-diffusion apertures 184, according to an alternate preferred embodiment of the present invention. Preferably, bladder wall 124 of each elastic body 150 comprises multiple air-diffusion apertures 184, as shown. Air-diffusion apertures 184 are preferably configured to disperse inflation air from the interior of elastic bodies 150 through bladder wall 124 to the region of passageway 115 between dynamic separation barrier 112 and entrance opening 111 (at least embodying wherein such at least one flexible material of each one of such fluid-inflatable bladders comprises at least one air permeable material having a plurality of holes distributed at least partially along such lateral length). FIG. 12D shows a sectional view, diagrammatically illustrating air venting by the alternate dynamic barrier 182 of FIG. 12C. The preferred diffusion of inflation air into passageway 115 is diagrammatically depicted by the dashed-line arrow depictions.

Alternate dynamic barrier 182 is preferably configurable to operate with a bladder wall 124 constructed from a non-permeable flexible material 151. This alternate preferred configuration allows development of elastic bodies 150 having large ruggedized regions 189; thus, alternate dynamic barrier 182 can be used in heavy traffic applications. Alternately preferably, bladder wall 124 can be constructed from a permeable flexible material 151.

Figure 12F:
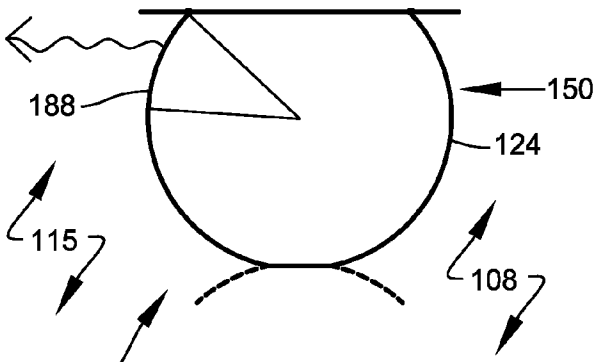
FIG. 12F shows a sectional view, diagrammatically illustrating air venting by the alternate dynamic barrier of FIG. 12E.
Figure 12E:
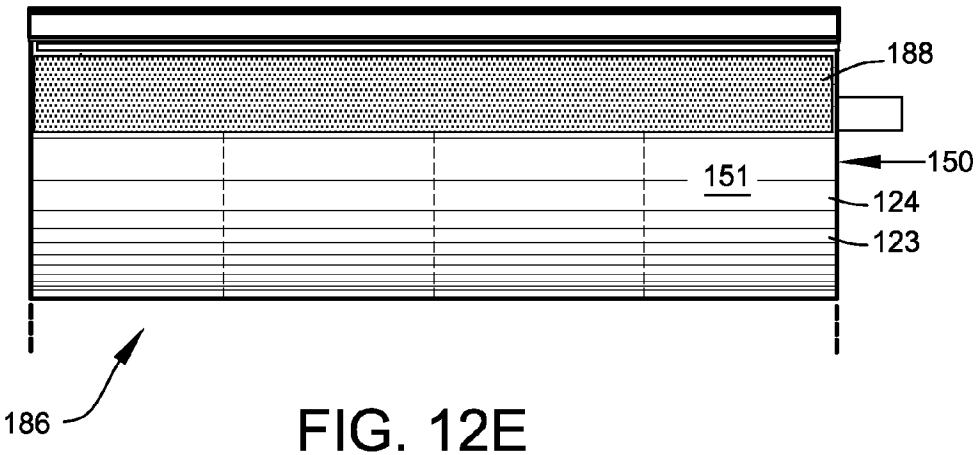
FIG. 12E shows an elevation view, showing an upper elastic body of an alternate dynamic barrier, containing an air-diffusion panel, according to another alternate preferred embodiment of the present invention.

FIG. 12E shows an elevation view, showing an upper elastic body 150 of an alternate dynamic barrier 186, preferably containing a porous air-diffusion panel 188, according to another alternate preferred embodiment of the present invention. Preferably, bladder wall 124 of each elastic body 150 comprises small porous air-diffusion panel 188, as shown. Air-diffusion panel 188 is preferably configured to permit permeation of inflation air from the interior of elastic bodies 150 through bladder wall 124 to the region of passageway 115 between dynamic separation barrier 112 and entrance opening 111 (at least embodying herein wherein at least one portion of such at least one flexible outer wall comprises at least one air-permeable material to permit permeation of air from an interior of such at least one air inflatable tube through such at least one portion of such at least one flexible outer wall). FIG. 12F shows a sectional view, diagrammatically illustrating air diffusion from the alternate dynamic barrier passageway of FIG. 12E. The preferred diffusion of inflation air into passageway 115 is diagrammatically depicted by the arrow depictions.

The relatively small porous air-diffusion panel 188 of alternate dynamic barrier 186 allows the majority of the elastic body 150 to comprise a non-permeable ruggedized region 189. Thus, alternate dynamic barrier 186 is especially useful in heavy use applications.

Figure 12G:
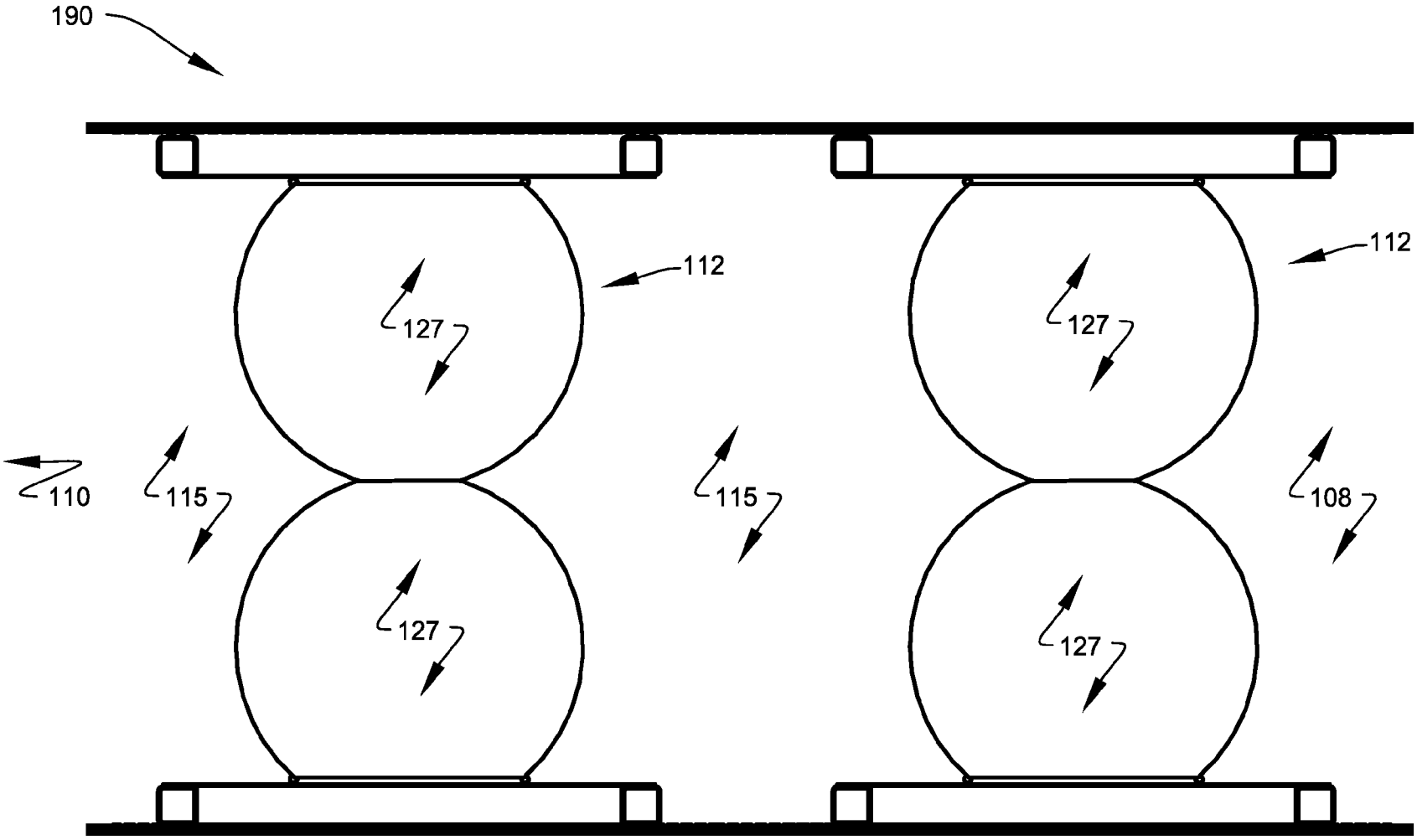
FIG. 12G shows a sectional view, showing an alternate dynamic barrier, containing multiple sets of dynamic isolation barriers, according to an alternate preferred embodiment of the present invention.

FIG. 12G shows a sectional view, showing an alternate dynamic barrier 190, preferably consisting of multiple sets of dynamic isolation barriers 112 arranged in series, according to an alternate preferred embodiment of the present invention. In this alternately preferable embodiment, passageway 115 contains an additional dynamic separation barrier 112 to further separate uncontrolled external environment 110 and habitable internal environment 108 (at least embodying herein wherein such at least one passageway further comprises at least one third separator to further separate the first area from the second area). Preferably, both dynamic isolation barriers 112 of alternate dynamic barrier 190 are of identical design (at least embodying herein wherein such at least one third separator comprises structures and arrangements matching substantially those of such at least one first separator).

Other alternate separators may be added to further restrict movement of contaminants from the uncontrolled external environment 110 into passageway 115. For example, referring again to FIG. 4, an additional separator in the form of a resilient strip curtain 192 may be installed over passageway 115. Resilient strip curtain 192 is preferably made of a plastic or vinyl material and comprises a preferred configuration similar to strip curtains used in warehouses to separate environments. Upon reading this specification, those with ordinary skill in the art will now appreciate that, under appropriate circumstances, considering such issues as design preference, user preferences, marketing preferences, cost, structural requirements, available materials, technological advances, etc., other contamination separator arrangements such as, for example, hatch flaps, air knives, pressure differentials, etc., may suffice.

Figure 13:
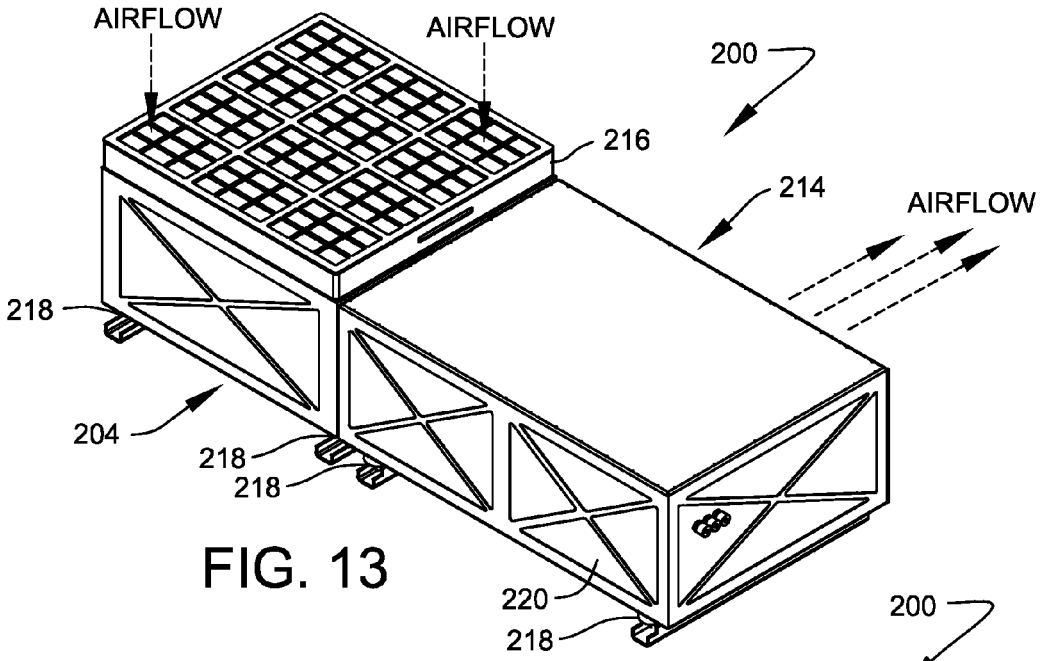
FIG. 13 shows a perspective view, illustrating a self-contained air revitalization unit, according to the preferred embodiment of FIG. 1.
Figure 14:
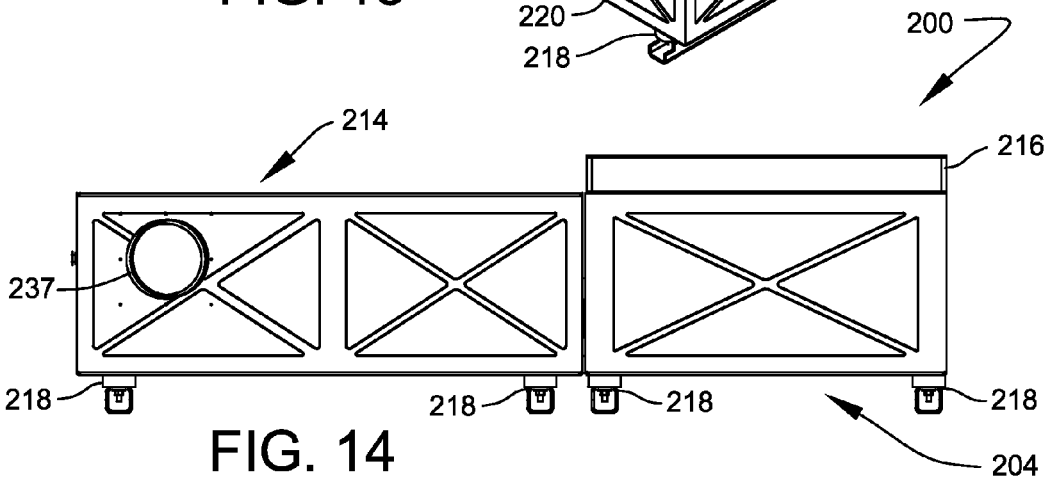
FIG. 14 shows a side view, illustrating the air revitalization unit of FIG. 13.
Figure 15:
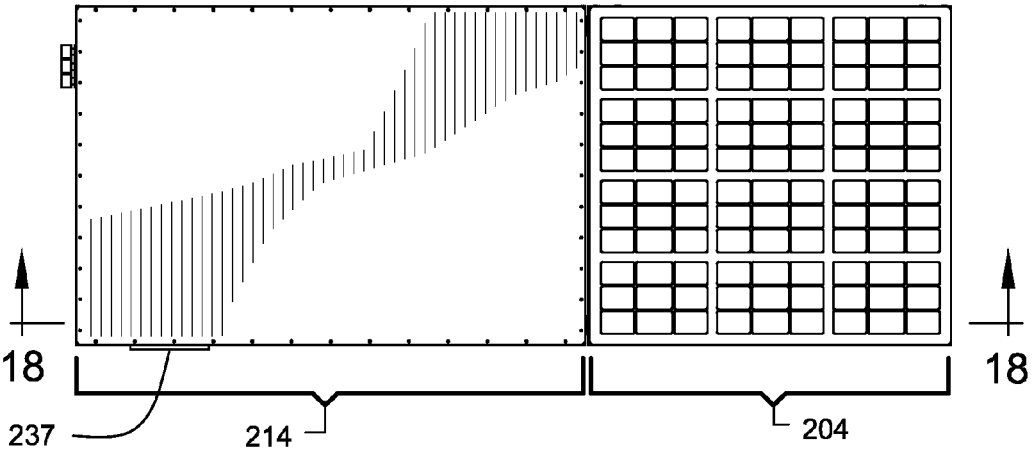
FIG. 15 shows a top view, illustrating the air revitalization unit of FIG. 13.

FIG. 13 shows a perspective view, illustrating the self-contained air revitalization unit 200, according to the preferred embodiment of FIG. 1. FIG. 14 and FIG. 15 show a side view and top view respectively of the air revitalization unit 200 of FIG. 13.

Air revitalization unit 200 preferably maintains the breathable atmosphere within occupant enclosure 117 in a condition consistent with sustaining the health of the human occupants. Air revitalization unit 200 is preferably designed to remove carbon dioxide and trace contaminants from the enclosed atmosphere within habitable internal environment 108. Trace contaminants removed by air revitalization unit 200 preferably include a specific set of metabolically generated organic compounds that pose a hazard to the occupants of emergency refuge 102. The unit preferably includes one or more reactor beds containing materials used to scrub contaminants from the air and preferably implements a means for generating airflow through the scrubbing media.

Figure 16:
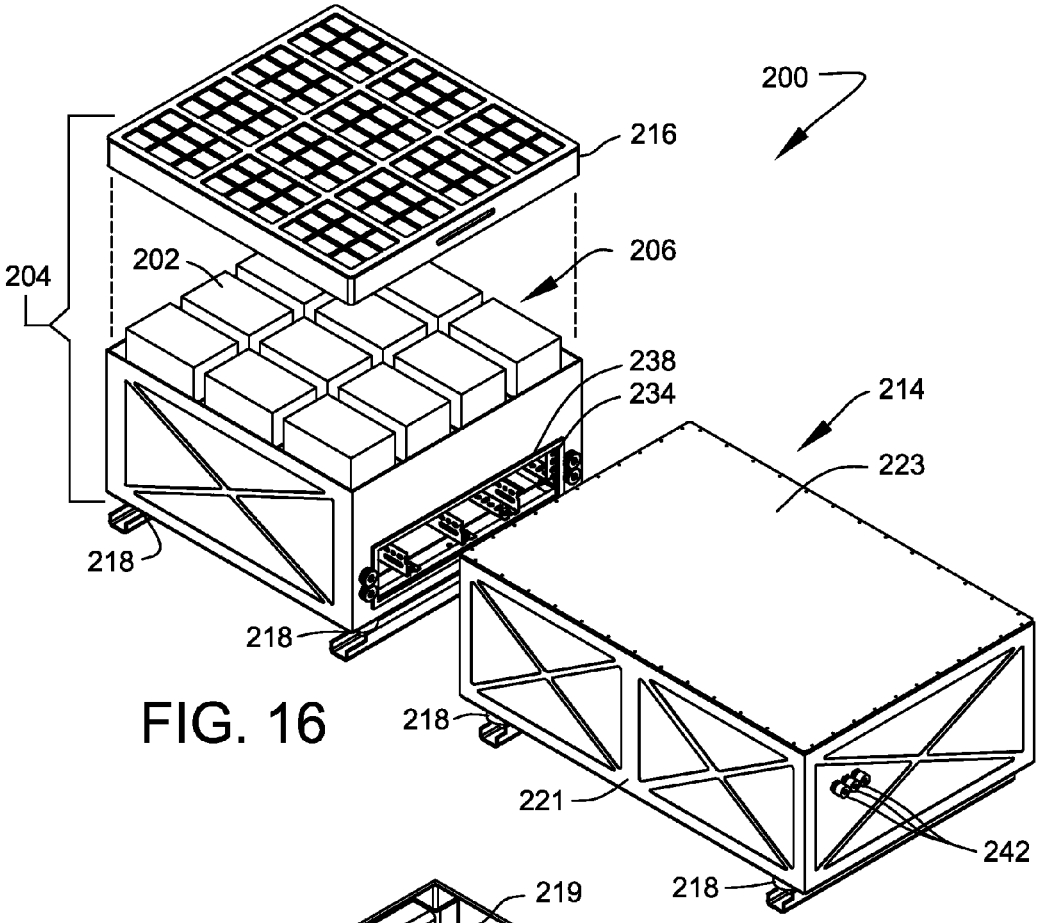
FIG. 16 shows and exploded perspective view, illustrating primary subassemblies of the air revitalization unit of FIG. 13.

FIG. 16 shows an exploded perspective view, illustrating the primary subassemblies of air revitalization unit 200. Air revitalization unit 200 preferably consists of two main subassemblies identified herein as scrubbing assembly 204 and fan assembly 214, as shown. Scrubbing assembly 204 preferably houses all "air-cleaning" chemicals used in air revitalization unit 200.

Fan assembly 214 preferably functions to move air through $CO_2$ removal bed 206 and reactor bed 216 of scrubbing assembly 204 to maximize their effectiveness. Scrubbing assembly 204 is preferably assembled in a manner that forces incoming air to flow sequentially through the upper reactor bed 216, into $CO_2$ removal bed 206, and finally through fan assembly 214. The arrow depiction of FIG. 13 diagrammatically illustrates the preferred path of ducted airflow within air revitalization unit 200 (at least embodying herein at least one air conductor structured and arranged to conduct at least one airflow derived from the at least one breathable atmosphere).

Scrubbing assembly 204 and fan assembly 214 are preferably joined together creating a single combined unit (see FIG. 13). The two assemblies are preferably coupled using mechanical fasteners and a resilient seal 238 to ensure no leakage occurs between the units. The material forming seal 238 is preferably configured to generate an airtight seal when compressed between the outer enclosures of scrubbing assembly 204 and fan assembly 214. Preferred mechanical fasteners include threaded fasteners to permit air revitalization unit 200 to be assembled and disassembled onsite. All fasteners passing through the units preferably employ thread-sealing washers to ensure that airtight seals are maintained at the penetrations.

The combined unit forming air revitalization unit 200 preferably attaches to a set of vibration-damping mounts 218, which are firmly secured to fixed structural members located within occupant enclosure 117 (see also FIG. 3). Upon reading this specification, those with ordinary skill in the art will now appreciate that, under appropriate circumstances, considering such issues as design preference, user preferences, marketing preferences, cost, structural requirements, available materials, technological advances, etc., other mounting arrangements such as, for example, locating an air revitalization unit within an adjacent mechanical space with remote ducting, providing an air revitalization unit utilizing a single unitary enclosure, etc., may suffice.

Figure 17:
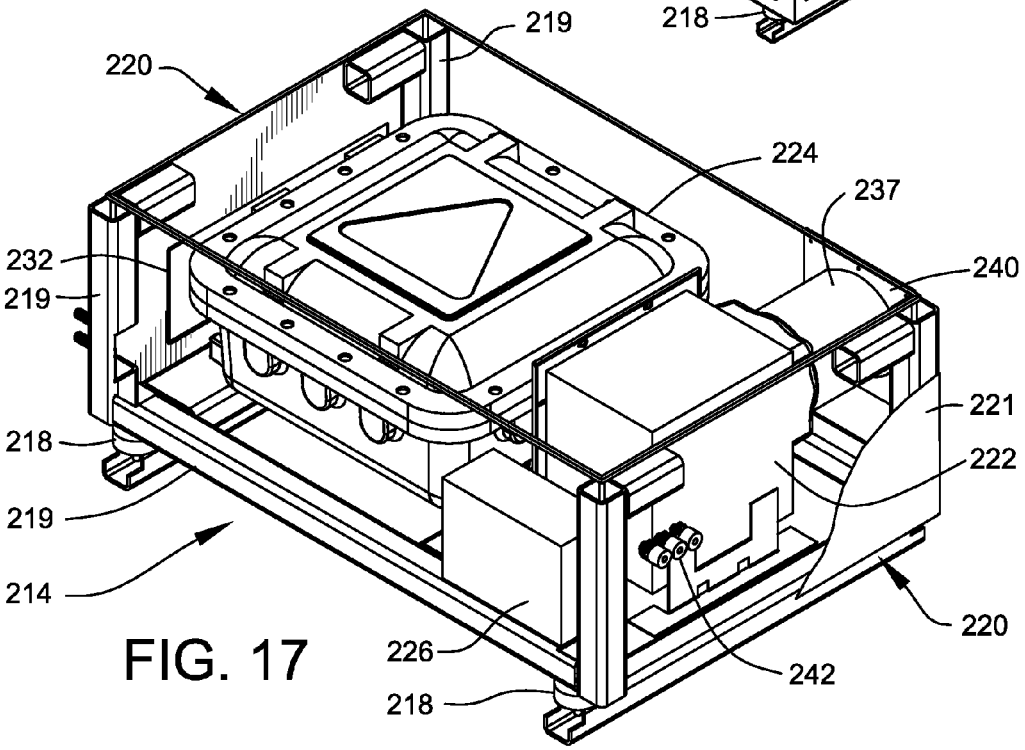
FIG. 17 shows a perspective view, illustrating operable components of a fan-enclosing subassembly of the air revitalization unit of FIG. 13.
Figure 18:
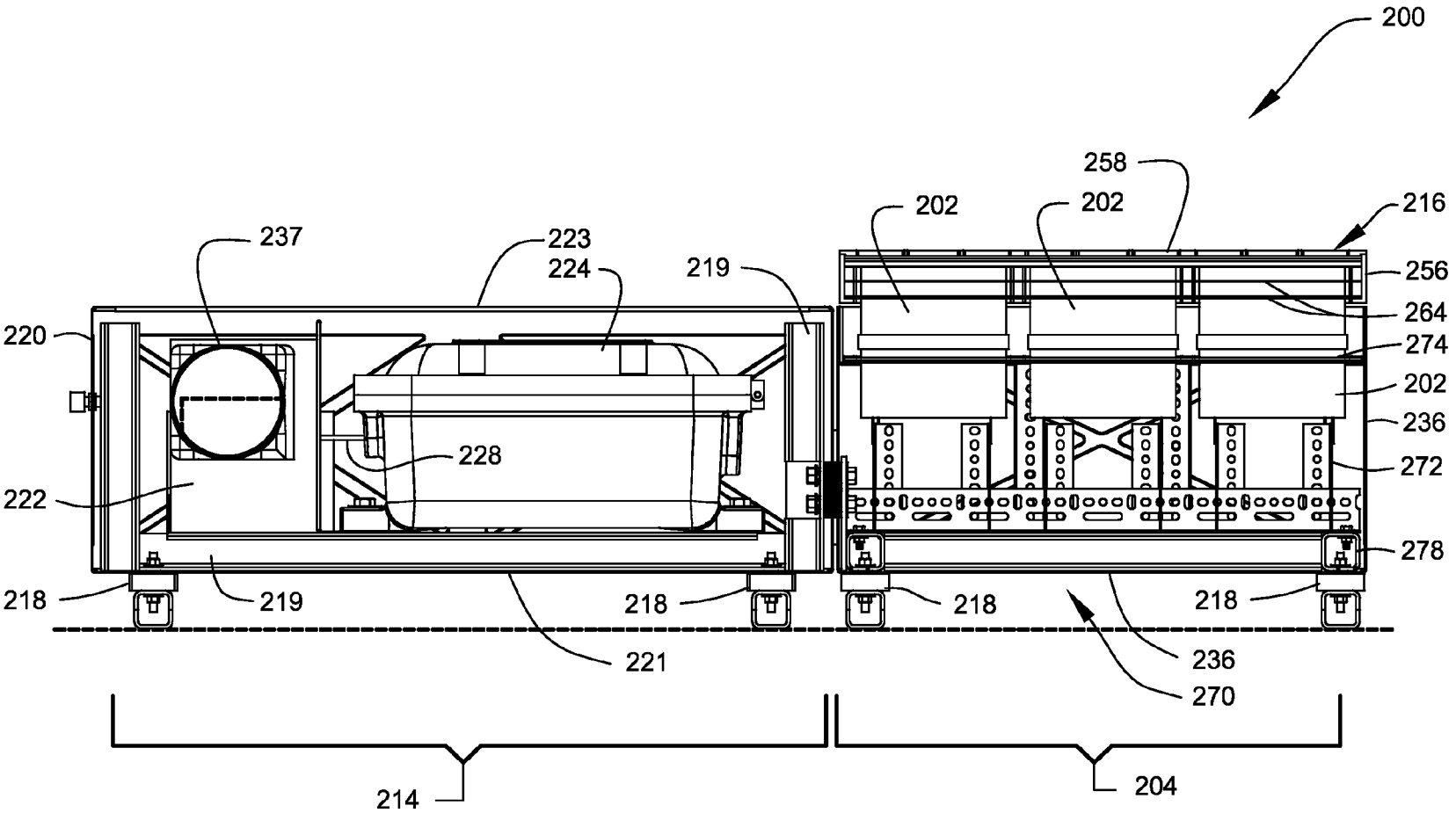
FIG. 18 shows the sectional view 18-18 of FIG. 15, illustrating preferred internal component arrangements of the air revitalization unit of FIG. 13.

FIG. 17 shows a perspective view, illustrating preferred operable components of fan assembly 214. In the depiction of FIG. 17, portions of an outer fan enclosure 220 have been omitted from the view to allow the internal component arrangements of the unit to be discussed. FIG. 18 shows the sectional view 18-18 of FIG. 15, illustrating preferred internal component arrangements of the combined air revitalization unit 200 including those of fan assembly 214.

Fan assembly 214 preferably contains all the powered components required to provide active air flow through scrubbing assembly 204 (at least embodying herein at least one air movement generator structured and arranged to generate movement of the at least one airflow between such at least one inlet and such at least one outlet). Fan assembly 214 preferably contains ventilation fan 222, explosion-proof box 224, and electrical junction box 226, as shown. Explosion-proof box 224 preferably houses at least one electrically-driven motor for outputting a rotational force at drive shaft 228. In addition, explosion-proof box 224 preferably houses batteries and a control board supporting operation of the motor (not shown). Alternately preferably, a trickle charger and deep-cycle battery are remotely located within the external mechanical room 119. Drive shaft 228 preferably extends outwardly from explosion-proof box 224 to operably engage ventilation fan 222, as best shown in the sectional view of FIG. 18.

A preferred explosion-proof box 224 is available from Venture Design Services Inc. of Liberty Lake, Wash. under the certification number 18-XPA110010-0. A preferred electrically-driven motor (fan driver) is available from Venture Design Services under the approval number 18-A110011-0. A preferred 24-volt DC power supply is Model number RSD2-PSD2-Ex4.349.5VDC (Approval number: 23-A080001-0) available from Venture Design Services Inc. of Liberty Lake, Wash.

Fan assembly 214 is preferably configured to provide a flow rate of between about 30 and 80 standard cubic feet per minute (between about 850 and 2265 liters per minute). Air is preferably ducted within the airtight fan enclosure 220 and passes adjacent the operable fan components contained therein. Upon reading this specification, those with ordinary skill in the art will now appreciate that, under appropriate circumstances, considering such issues as design preference, user preferences, marketing preferences, cost, structural requirements, available materials, technological advances, etc., other fan arrangements such as, for example reorganizing the operable components to improve airflow, supplying power from an external source, etc., may suffice.

Ventilation fan 222, explosion-proof box 224, and electrical junction box 226 preferably rest on support frame 219 situated inside of the airtight fan enclosure 220. Support frame 219 preferably consists of sections rigid metallic tubing joined by thermal welding. Support frame 219 preferably provides the main mounting locations and support for ventilation fan 222, explosion-proof box 224, and electrical junction box 226. Support frame 219 and supported components are preferably placed inside of fan enclosure 220 and are firmly secured to the vibration-damping mounts 218 using fasteners extending through the enclosure wall of fan enclosure 220. Thread-sealing washers are preferably used, to ensure an airtight seal is maintained at mounting penetrations extending through fan enclosure 220.

Fan enclosure 220 is preferably comprised of an airtight box 221 with a removable lid 223 (see FIG. 16). A rectangular aperture 232 is preferably formed in one end of box 221, as shown. Rectangular aperture 232 is preferably configured to co-align with a corresponding rectangular aperture 234 located within outer enclosure 236 of scrubbing assembly 204 (see FIG. 16). Peripheral seal 238 is preferably placed between fan enclosure 220 and scrubbing assembly 204 to seal the mating interface between rectangular aperture 232 and rectangular aperture 234. Peripheral seal 238 is preferably constructed from a single section of closed-cell foam. Alternately preferably, a rectangular section of ducting is used to connect the two enclosures with a wiper seal used to create an airtight boundary.

Air is preferably exhausted from fan enclosure 220 through a section of circular ducting 237 extending from the outlet of fan assembly 214 outwardly through a circular aperture 238, as shown (at least embodying herein at least one outlet to outlet the at least one airflow from such at least one air conductor). In the present preferred embodiment, circular ducting 237 comprises a preferred diameter of about 6 inches (15.4 centimeters). The boundary between fan enclosure 220 and circular ducting 237 is preferably sealed using wiper seal 240, as shown. Wiper seal 240 preferably consists of silicone rubber captured between the interior of the box and an additional sheet-metal panel. Wiper seal 240 is preferably configured to have an interference clearance around the periphery of ducting 237 of about ¼ inch (0.6 centimeters). A bead of silicone caulking is preferably applied on either side of the silicone rubber wiper seal 240, at the points of sheet-metal contact, to ensure a proper seal is made. Wiper seal 240 is preferably fastened in place using self-sealing pop rivets.

A set of three cord "pass-throughs" 242 are preferably provided to allow electrical cables serving electrical junction box 226 to pass through fan enclosure 220. The assembly is preferably airtight and does not permit airflow through any interface other than the designed inlet and outlet. Upon reading this specification, those with ordinary skill in the art will now appreciate that, under appropriate circumstances, considering such issues as design preference, user preferences, marketing preferences, cost, structural requirements, available materials, technological advances, etc., other electrical cable arrangements such as, for example, more or less aperture "pass-throughs", other wiring arrangements, other power arrangements, etc., may suffice.

Both removable lid 223 and box 221 are preferably constructed of sheet metal with 18-gauge steel being most preferred. The sheet metal is preferably powder coated to avoid corrosion issues associated with moisture generated by occupant respiration and the refuge environment.

Removable lid 223 is preferably mounted to box 221 in at least one tamper-proof manner. Removable lid 223 is preferably mounted to box 221 in a semi-permanent manner using self-sealing pop rivets. Alternately preferably, removable lid 223 is preferably mounted to box 221 using 3M™ VHB™ tape and a bead of silicone caulking or 3M™ VHB™ tape laid inward of the rivets. Preferred tape products are provided by 3M Corporation of St. Paul, Minn. This preferred mounting arrangement prevents unauthorized access to critical components within fan enclosure 220 after installation. Preferably, the seal between removable lid 223 and box 221 is airtight.

Figure 19:
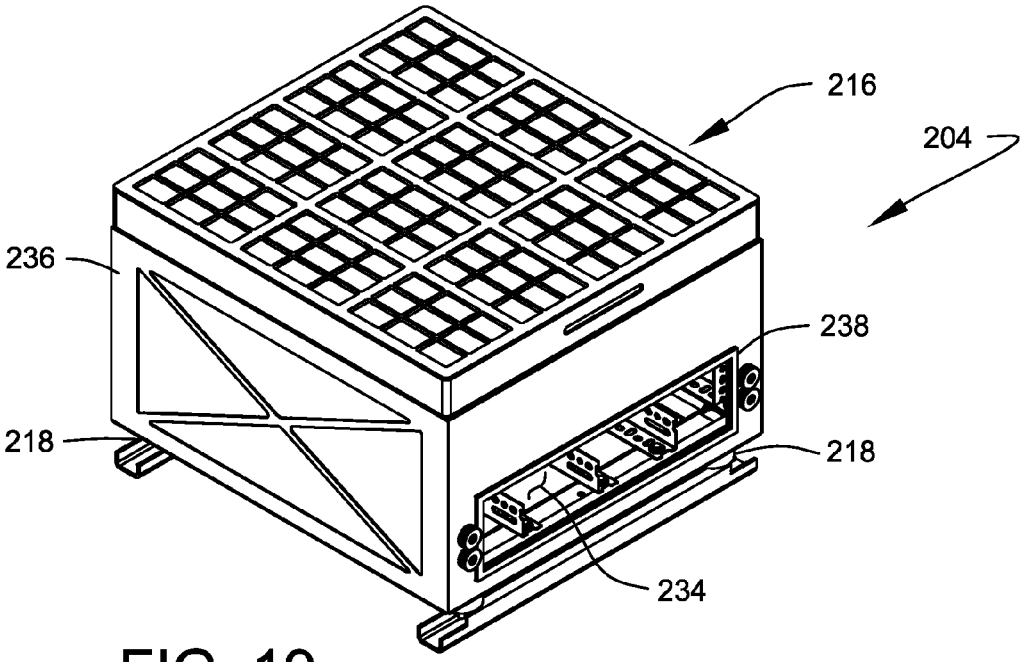
FIG. 19 shows a perspective view, illustrating a scrubbing subassembly of the air revitalization unit of FIG. 13.
Figure 20:
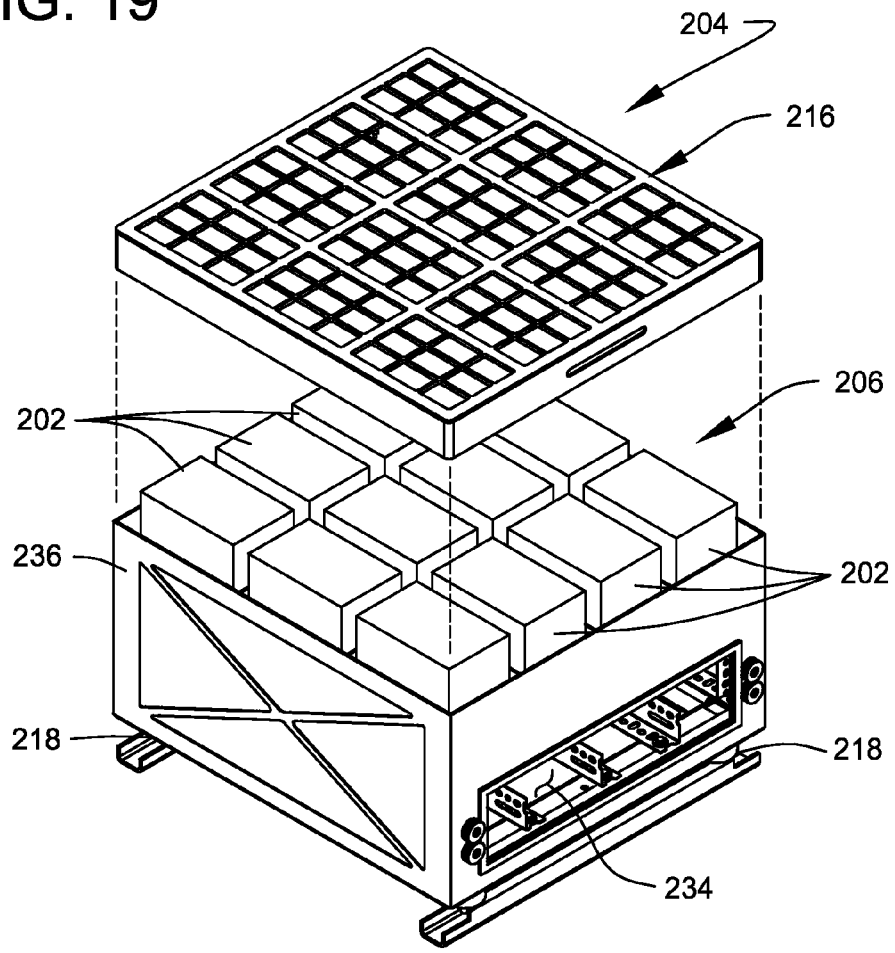
FIG. 20 shows an exploded view, further illustrating the scrubbing subassembly of the air revitalization unit of FIG. 13.

FIG. 19 shows a perspective view, illustrating scrubbing assembly 204 of the air revitalization unit of FIG. 13. FIG. 20 shows an exploded view, further illustrating scrubbing assembly 204 of air revitalization unit 200.

Scrubbing assembly 204 preferably contains $CO_2$ removal bed 206 and reactor bed 216, as shown. Reactor bed 216 preferably contains chemical media for the removal of trace contaminants. Reactor bed 216 is preferably configured to sit atop $CO_2$ removal bed 206, as shown, and is preferably configured to be a removable component of scrubbing assembly 204, thus permitting direct access to $CO_2$ removal bed 206. The combined ducting structure of $CO_2$ removal bed 206 and reactor bed 216 preferably creates a sealed pathway for airflow through the scrubbing media. In the exploded depiction of FIG. 20, reactor bed has been separated from scrubbing assembly 204 to expose $CO_2$ removal bed 206.

$CO_2$ removal bed 206 preferably contains at least one chemical media for the absorptive removal of $CO_2$ from the isolated atmosphere of habitable internal environment 108. Table A provides preferred baseline design values for establishing $CO_2$ removal requirements within occupant enclosure 117 (habitable internal environment 108).

TABLE A preferred baseline design values for establishing $CO_2$ removal requirements:

| No. | Design Requirement | Value |
|---|---|---|
| 1 | Approximate internal volume of occupant enclosure 117 (habitable internal environment 108): | 480 $ft^3$ (13.6 $m^3$) |
| 2 | Maximum occupants within occupant enclosure 117 (habitable internal environment 108): | 16 |
| 3 | Operational duration: | 96 hour s |
| 4 | Allowable average $CO_2$ concentration: | 10,000 ppm (1.0%) or less |
| 5 | Rate of $CO_2$ generated by Occupants: | 1.08 $ft^3$/person-hour (1.31 kg/person-day) |
| 6 | Maximum allowable short-term $CO_2$ concentration: | Not to exceed 25,000 ppm (2.5%) |

Applicant identified two principal candidate $CO_2$ absorption chemistries for use within the present system. Both chemistries utilize alkaline absorbents to react $CO_2$ into a stable carbonate. Preferred chemistries for use in the present system included Lithium Hydroxide (LiOH) and Calcium Hydroxide (CaOH) sorbent compounds. After analysis of performance and cost data, reactive plastic calcium hydroxide (RP CaOH) was ultimately chosen as the most preferred chemistry for $CO_2$ control in the final design. Through experimental testing, applicant determined that RP CaOH sorbent having a total mass of about 515 lbs (234 kg) would provide sufficient $CO_2$ control for a 96-hour operational duration. In this preferred arrangement, fan assembly 214 is preferably configured to maintain an air circulation rate of between about 30 and about 80 standard cubic feet per minute (between about 850 and 2265 liters per minute) through the sorbent media.

RP CaOH sorbent media is preferably supplied the form of multiple pre-packaged $CO_2$ absorption modules 202.

Each $CO_2$ absorption module 202 preferably comprises a weight of less than about 12 pounds. This preference allows for the development of a compact $CO_2$ removal bed 206 that is capable of being serviced by occupants of emergency refuge 102.

Each $CO_2$ absorption module 202 preferably comprises an air channel extending through the module, which preferably contains a stack of absorbent sheets into which calcium hydroxide particles are bound. Small open particles of CaOH (advantageous for absorption of $CO_2$) are preferably bound into the sheet by microscopic filaments of polymeric material. Preferably, a small amount of binder polymer holds the particles firmly together. The sheets are preferably stacked and placed within outer packaging to form the rectangular-shaped $CO_2$ absorption module 202. Table B provides preferred physical characteristics of $CO_2$ absorption module 202.

TABLE B preferred physical characteristics of $CO_2$ absorption module 202:

| No. | Design Requirement | Value |
|---|---|---|
| 1 | $CO_2$ absorption module 202 dimensions: | Flow area of about 12.65 cm (4.98 inches) × about 19.43 cm (7.65 inches) bed depth of about 20.19 cm (7.95 inches) |
| 2 | Mass of each $CO_2$ absorption module 202: | About 11.24 lbs (5.1 kg) |
| 3 | Sorbent capacity of each $CO_2$ absorption module 202: | 0.27 kg $CO_2$/kg sorbent (0.60 lb $CO_2$/lb sorbent) |
| 4 | Density of RP CaOH: | about 0.037 lb/in$^3$ (1.03 g/cc) |

For ease of operation and maintenance, scrubbing assembly 204 is preferably designed to use sets of commercially available $CO_2$ absorption modules. Preferred absorption modules, suitable for use as $CO_2$ absorption modules 202, include RP CaOH-based modules produced by Micropore of Elkton, Md. and marketed under the trade name PowerCube™. Upon reading this specification, those with ordinary skill in the art will now appreciate that, under appropriate circumstances, considering such issues as design preference, user preferences, marketing preferences, cost, structural requirements, available materials, technological advances, etc., other scrubbing bed arrangements such as, for example, using fewer modules of greater individual capacity, using a single large-capacity bed, using a regenerative carbon dioxide removal system (RCRS), using a membrane-based gas separator, using as of yet invented chemistries/methods, etc., may suffice.

Figure 21:
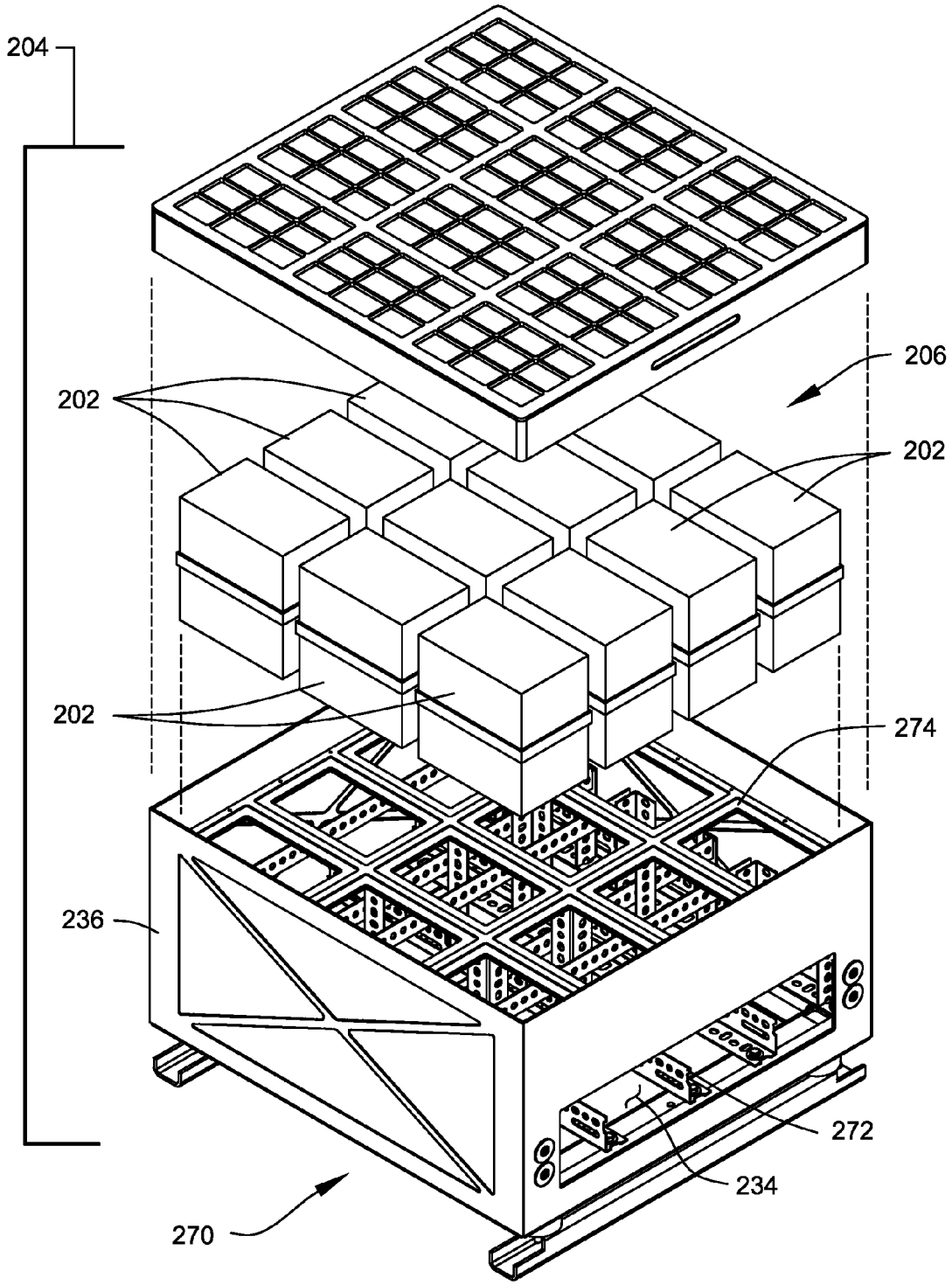
FIG. 21 shows another exploded view, further illustrating the scrubbing subassembly of the air revitalization unit of FIG. 13.

FIG. 21 shows another exploded view, illustrating the $CO_2$ absorption modules 202 separated from scrubbing assembly 204. FIG. 21 shows the twelve (12) independent CaOH-based CO2 absorption modules 202 that are preferably arranged in a four by three array within scrubbing assembly 204. Table C provides preferred design values for CaOH-based $CO_2$ absorption modules 202 utilized in Scrubbing assembly 204.

TABLE C preferred design values for CaOH-based $CO_2$ absorption modules 202:

| No. | Design Requirement | Value |
|---|---|---|
| 1 | Number of $CO_2$ absorption modules 202 required: | 46 (48 cubes are preferably employed to accommodate the preferred 12-module array of as illustrated in FIG. 21) |

TABLE C-continued preferred design values for CaOH-based $CO_2$ absorption modules 202:

| No. | Design Requirement | Value |
|---|---|---|
| 2 | Number of $CO_2$ absorption modules 202 required in parallel: | 12 |
| 3 | Pressure drop through a bed comprising 12 $CO_2$ absorption modules 202 in parallel: | About 0.16 inches $H_2O$ ($4 \times 10^2$ kilopascal) |
| 4 | Change out frequency of $CO_2$ absorption modules 202: | 4 times over a 96 hour period or every 24 hours |
| 5 | Flow rate per $CO_2$ absorption module 202: | Between about 3 and 7 cfm per module (between about 85 and 200 clm) |
| 6 | Superficial (linear) velocity: | 11.97 ft/min (3.65 m/min) |

The following sections describe the preferred structures and arrangements of reactor bed 216 used to remove trace contaminants from the isolated atmosphere of habitable internal environment 108. Table D provides a list of trace contaminants and generation rates expected during system operation.

TABLE D trace contaminants and generation rates:

| Contaminant | Maximum allowable concentrations (mg/m3) | Metabolic Rate (mg/person-d) | Generation Amount (mg/m3) (assuming the minimum30 ft$^3$/person) |
|---|---|---|---|
| Methanal | 0.12 | 0.4 | 1.88 |
| Benzene | 1.5 | 2.2 | 10.35 |
| Furan | 0.07 | 0.3 | 1.41 |
| Ammonia | 2 | 50 | 235.25 |
| Carbon Monoxide | 63 | 18 | 84.69 |

Figure 22:
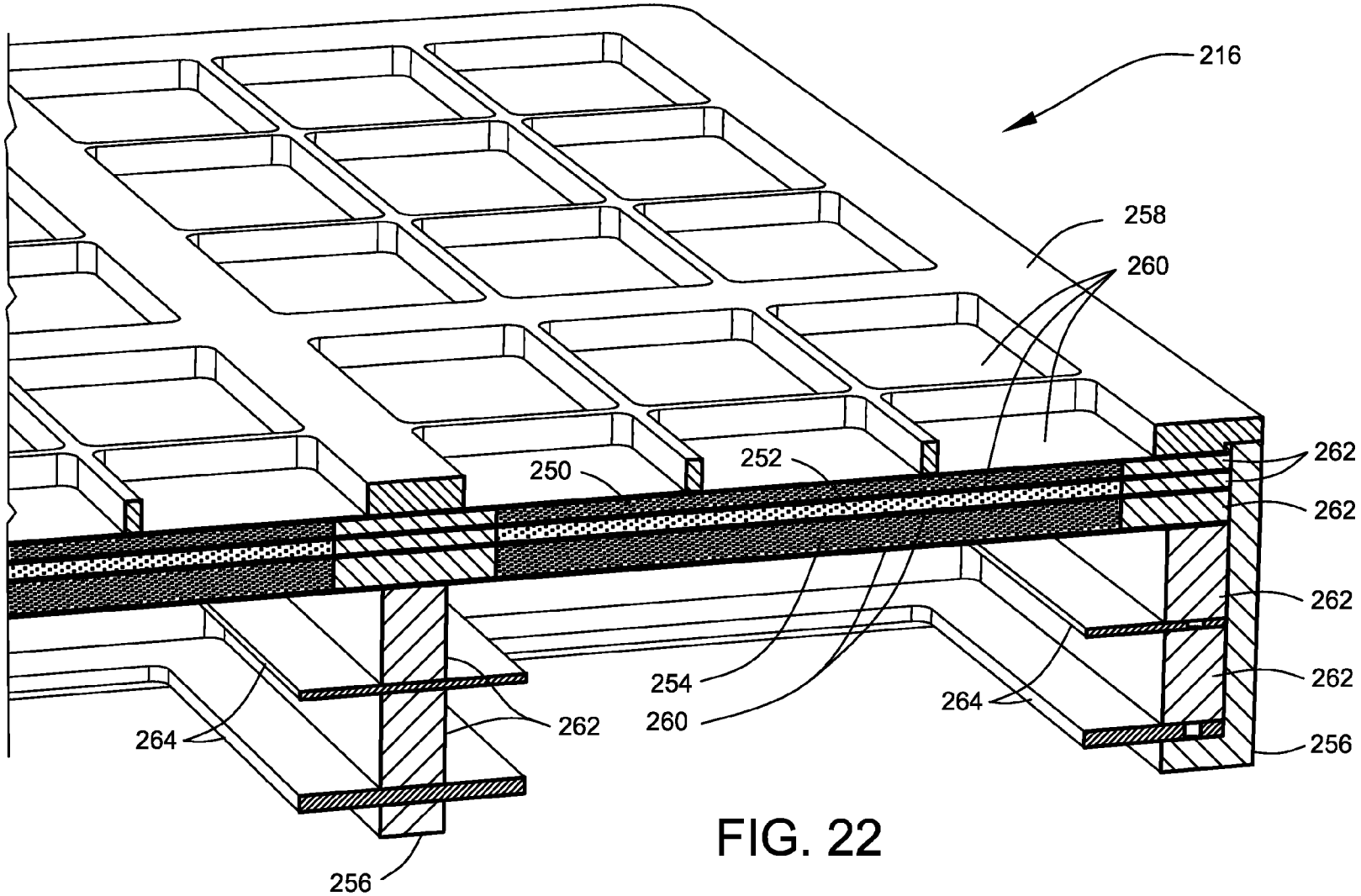
FIG. 22 shows a perspective view, in partial section, illustrating an assembled reactor bed of the reactor-bed subassembly of FIG. 19.
Figure 23:
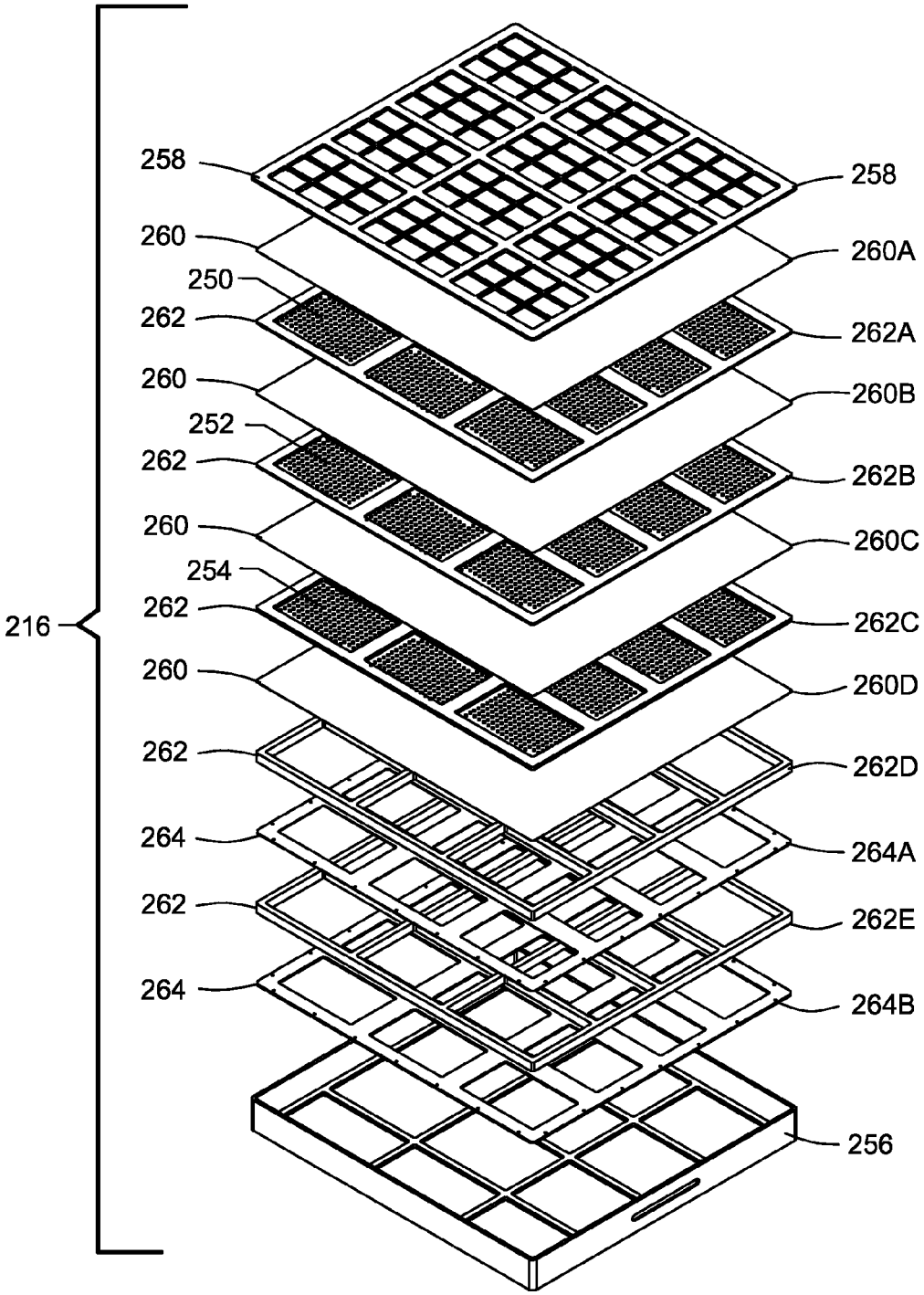
FIG. 23 shows an exploded perspective view, illustrating preferred subcomponent arrangements of the reactor bed.

FIG. 22 shows a perspective view, in partial section, illustrating an assembled reactor bed 216 of the reactor-bed subassembly of FIG. 19. FIG. 23 shows an exploded perspective view, illustrating preferred subcomponent arrangements of reactor bed 216. Reactor bed 216 preferably contains a set of chemical media beds functioning to remove the trace contaminants listed in Table D.

Air flow preferably enters scrubbing assembly 204 through reactor bed 216. Within reactor bed 216, air preferably passes sequentially through three individual trace-contaminant reactor beds preferably containing volatile organic compound (VOC) removal media 250, Ammonia removal media 252, and an ambient-temperature catalytic oxidizer identified herein as ATCO media 254. Reactor bed 216 is preferably designed to support the above-noted removal media within the passing airflow. Reactor bed 216 preferably consists of reactor-bed housing 256 and reactor-bed lid 258 containing a plurality of wire mesh panels 260, spacers 262, and wiper seals 264, as shown. In a preferred arrangement of the present system, reactor bed 216 preferably consists of, in top-down sequence, reactor-bed lid 258, wire mesh panel 260A, spacer 262A, wire mesh panel 260B, spacer 262B, wire mesh panel 260C, spacer 262C, wire mesh panel 260D, spacer 262D, thin wiper seal 264A, spacer 262E, thick wiper seal 264B and reactor-bed housing 256, as shown.

The chemical media forming the individual trace-contaminant reactor beds is preferably held within aperture openings located within the three upper spacers 262 and is preferably captured between adjacent wire mesh panels 260, as shown. The thickness of three upper spacers 262 are preferably selected based on the amounts of trace-contaminant removal media utilized in each bed.

VOC removal media 250 for the removal of formaldehyde, benzene, and furan preferably comprises at least one carbon tetrachloride impregnated activated carbon media. At least 60 percent CCl4 treatment is preferably applied to the media for formaldehyde removal. VOC removal media 250 is preferably contained within spacer 262A, as shown. A preferred product, suitable for use as VOC removal media 250, is sold under the name Chemsorb 1505 by Molecular Products, Inc. of Boulder Colo.

Ammonia removal media 252 for the removal of airborne ammonia and amines preferably comprises at least one phosphoric acid carbon compound. Ammonia removal media 252 is preferably contained within spacer 262B, as shown. A preferred product, suitable for use as ammonia removal media 252, is sold under the name Chemsorb 1425 by Molecular Products, Inc. of Boulder Colo.

Oxidation of Carbon Monoxide (CO) is preferably accomplished using at least one precious metal ambient temperature catalyst, with a media based on two percent platinum (Pt) on Gold (Au) being preferred. Alternately preferably, a media based on gold on metal-oxide is acceptable. A preferred Ambient Temperature Catalytic Oxidizer, suitable for use as ATCO media 254, may be sourced from TDA Research, Inc. of Wheat Ridge, Colo. ATCO media 254 is preferably contained within spacer 262C, as shown.

The preferred amounts removal media utilized in reactor bed 216 is listed in Table F below. For the required adsorption capacity for the metabolically generated $NH_3$ generated about 553 grams of ammonia removal media 252 required. The preferred amount of VOC removal media 250 required for adsorption capacity for the metabolically generated VOCs (CHOOH, $C_6H_6$, $C_4H_4O$ and $(CH_3)_2CO$) is also about 553 grams.

A preferred bed design was developed utilizing individual bed depths for the ammonia and VOC sorbents fixed at ⅛ inch each (about 0.3 centimeters). The smallest chemical media size preferably used is a 12×20 mesh (1.4 millimeters by 0.8 millimeter). One this basis, a metal media retention screen size of about 30 by 30 wire mesh was preferably selected. Using a total bed depth (VOC and $NH_3$) of ¼ inch (0.6 centimeters), the configuation produces a pressure drop (dP) of about 0.05 inch $H_2O$ (about $4\times10^{-2}$ kilopascal). Using the above-noted flow rate of fan assembly 214 (between about 36 and 40 standard cubic feet per minute), the preferred bed design resulted in a residence time of about 0.1 seconds for both the VOC and ammonia beds. Testing confirmed the ability of the preferred bed configuration to maintain concentrations below the maximum values given in Table D, based on generation rates for 16 occupants. Minimum per pass removal efficiencies are given in Table E.

TABLE E

Minimum Removal Efficiencies (per Pass) Required for Trace Contaminant Control

| Contaminant | Minimum Removal Efficiency Per Pass |
|---|---|
| Methanal (Formaldehyde) | 3.5% |
| Benzene | 2.0% |
| Furan | 4.5% |
| 2-propanone (Acetone) | 0.5% |
| Ammonia | 26% |

An alternate design comprising a bed depth of about 1½ inches (about 3.8 centimeters) per sorbent with a residence time of 0.2 second was developed. Although this alternate preferred configuration provides increased per-pass removal efficiency, experimental data indicated that the increased bed depth produces a dP of approximately 0.7 inches of water (about 0.17 kilopascal). The higher dP falls outside the performance profile of applicant's preferred fan assembly 214. Therefore, utilization of a bed depth of about 1½ inches (about 3.8 centimeters) per sorbent requires a fan assembly of higher output, with a corresponding increase in power (battery) consumption.

A preferred removal rate of 0.2 mg/min is required for CO. Reactor bed 216 preferably comprises an ATCO bed area of about 457 square inches (about 0.29 square meters) and bed thickness of ¼ inch (0.6 centimeters). A residence time of 0.1 second is preferably established through ATCO media 254 given a preferred flow rate of between about 30 and about 80 standard cubic feet per minute (between about 850 and 2265 liters per minute). The preferred amount of ATCO media 254 utilized in reactor bed 216 is listed in Table F.

TABLE F

Media Quantity, Size and Bed Depth Summary (Reactor Bed 216):

| Media Type/Size | Quantities |
|---|---|
| VOC removal media 250 required: | 553 grams |
| Ammonia removal media 252 required: | 553 grams |
| ATCO media 254 required: | 824 grams |
| Total flow area throughVOC removal media 250: | 457.2 $in^2$ (0.29 $m^2$) |
| Bed depth containing VOC removal media 250: | ⅛ inch (0.3 cm) |
| Total flow area through ammonia removal media 252: | 457.2 $in^2$ (0.29 $m^2$) |
| Bed depth containing ammonia removal media 252: | ⅛ inch (0.3 cm) |
| Total flow area through ATCO media 254: | 457.2 $in^2$ (0.29 $m^2$) |
| Bed depth containing ATCO media 254: | ¼ inch (0.6 cm) |
| Pressure drop across VOC, $NH_3$ and ATCO bed (total bed): | 0.16 inch $H_2O$ ($4 \times 10^2$ kilopascal) |

Each wire mesh panel 260 preferably consists of a 30-inch square air-permeable barrier used to ensure the carbon media does not migrate into other media layers. Each wire mesh panel 260 preferably comprises wires having diameters of about 0.012 inch (0.3 millimeter) preferably arranged to comprise a maximum opening width of about 0.02 inch (about 0.5 millimeter). Stainless steel was chosen as it does not negatively react with any of the carbon media used in reactor bed 216. A bead of silicone is preferably used between each wire mesh panel 260 and spacers 262 to assist in keeping the wire mesh in place.

Figure 24:
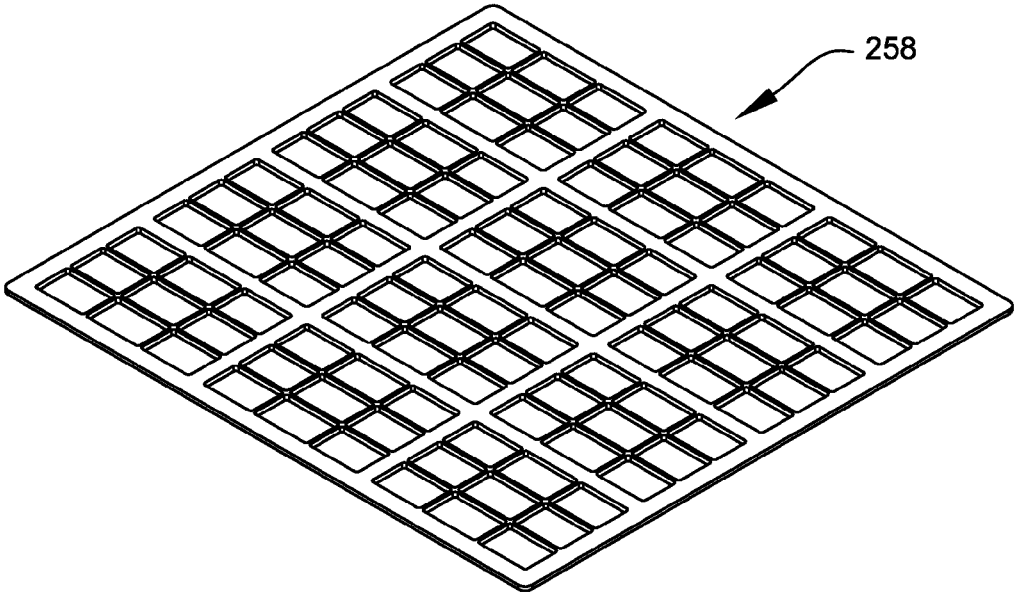
FIG. 24 shows a perspective view, illustrating a reactor-bed lid of the reactor bed.

FIG. 24 shows a perspective view, illustrating reactor-bed lid 258. Reactor-bed lid 258 preferably comprises a generally planar member having a grid-like arrangement of openings for the passage of air. Reactor-bed lid 258 is preferably constructed from a rigid material having a chemical resistance appropriate to the exposure environment. Preferably, reactor-bed lid 258 is constructed from a chemically resistant plastic, preferably polycarbonate.

Reactor-bed lid 258 is preferably joined with reactor-bed housing 256 in a permanent manner. Reactor-bed lid 258 is preferably joined with reactor-bed housing 256 using bonding, alternately preferably ultrasonic welding, or alternately preferably by taping using 3M™ VHB™. Regardless of the selected joining method, the seal between the lid and housing must be airtight.

Polycarbonate was preferably chosen based on chemical stability when in contact with the reactants, superior strength, and minimal out-gassing characteristics. Alternately, some metallic compositions may be used; however, most metallic compositions are less preferred due to the chemical incompatibility with the media being contained and the cost of using more resistive metals. In addition, reactor bed 216 is preferably configured to be a single-use component, thus eliminating the need to refurbish used beds. In this regard, a preference for plastic structures is significantly more cost effective.

Figure 25:
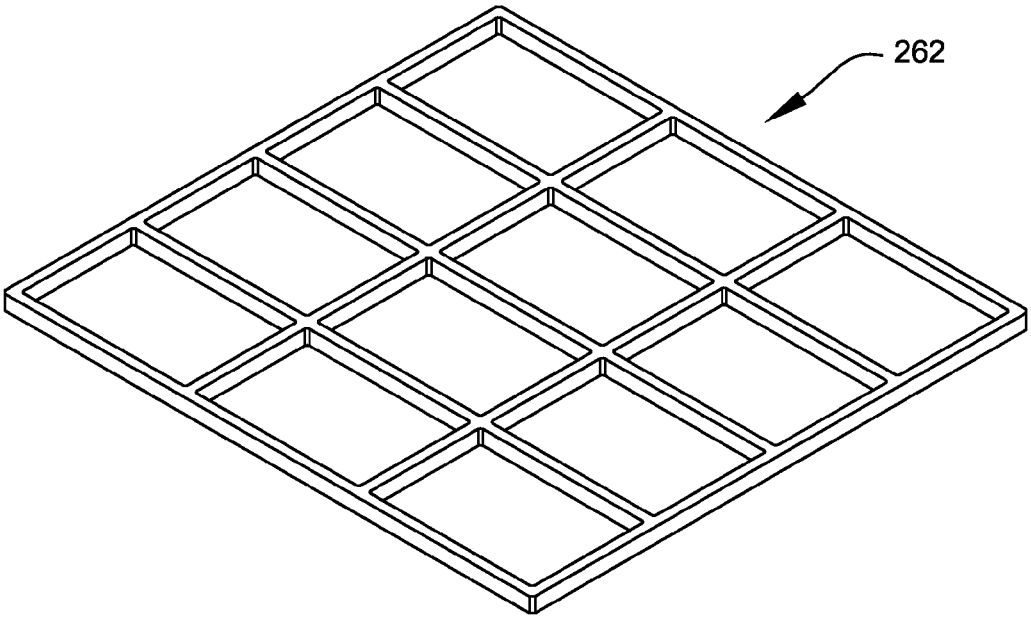
FIG. 25 shows a perspective view, illustrating a reactor-bed spacer of the reactor bed.

FIG. 25 shows a perspective view, illustrating a reactor-bed spacer 262 of reactor bed 216. Spacers 262 preferably function to ensure an appropriate amount of media is used in each reactor bed is provided and to allow the upper portion of the $CO_2$ absorption modules 202 to enter reactor bed 216 when engaged on scrubbing assembly 204 (see FIG. 18). Spacers 262 preferably comprise thicknesses of ⅛ inch (about 3.2 millimeters), ¼ inch (about 6.4 millimeters), and ¾ inch (about 19 millimeters). With regard to reactor bed 216, spacer 262A containing VOC removal media 250, comprises a preferred thickness of about ⅛ inch (3.2 millimeters). Spacer 262B, containing ammonia removal media 252, comprises a preferred thickness of about ⅛ inch (about 3.2 millimeters). Spacer 262C, containing ATCO media 254, comprises a preferred thickness of about ¼ inch (about 6.4 millimeters).

Spacer 262D and spacer 262E function to position wiper seals 264. Both spacer 262D and spacer 262E each comprise a preferred thickness of about ¾ inch (about 19 millimeters).

Experimental testing indicated that structural support is needed at the center of the beds to keep the beds from bowing outward due to the media packing. To prevent wire mesh panels 260 from curling and fraying, the periphery of the mesh layers are clamped between the spacers. Spacers 262 are preferably configured to provide a peripheral contact region used to apply a clamping force to restrain the wire mesh panels 260. In addition, a bead of silicone caulking is preferably applied between spacers 262 and the adjacent mesh panels 260, to assist in keeping the mesh panels in place and to ensure that there is no separation between media layers. Spacers 262 are preferably constructed of rigid plastic with polycarbonate being preferred. Alternately preferably, spacers are preferably constructed of Neoprene rubber. Polycarbonate and Neoprene were chosen based on chemical compatibility and ease of manufacture.

Figure 26:
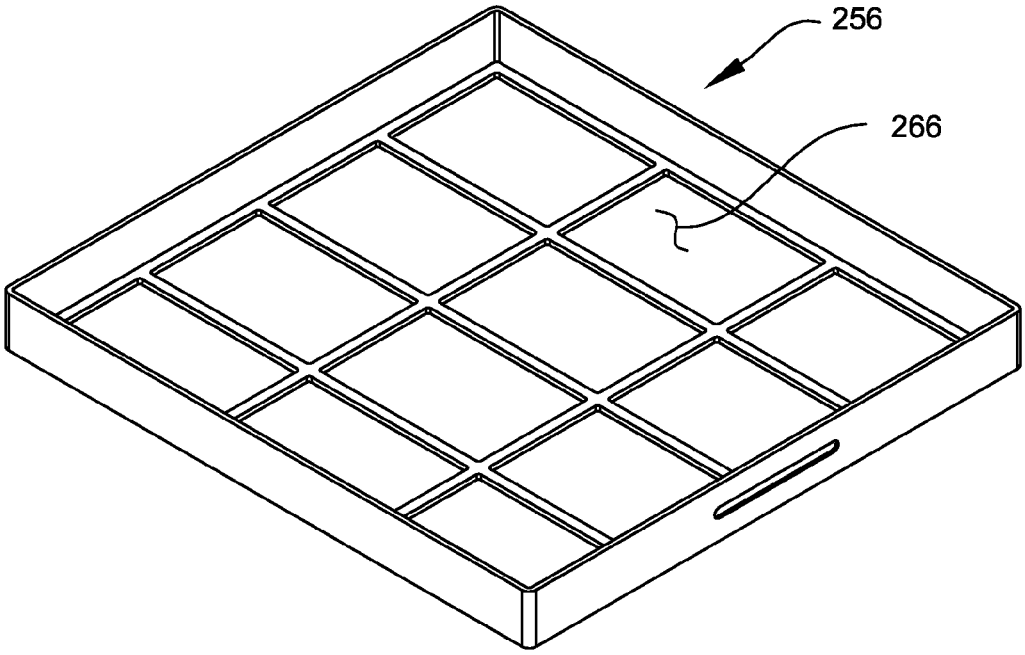
FIG. 26 shows a perspective view, illustrating a reactor-bed housing of the reactor bed.

FIG. 26 shows a perspective view, illustrating reactor-bed housing 256 of reactor bed 216.

Reactor-bed housing 256 preferably comprises a single unitary structure constructed of a chemically-resistant plastic, preferably polycarbonate. Reactor-bed housing 256 preferably contains a grid-like arrangement of lower apertures 266 that are preferably sized to allow the upper portion of the $CO_2$ absorption modules 202 to enter reactor bed 216 when reactor bed 216 is engaged with scrubbing assembly 204 (see FIG. 18). The housing is preferably provided with a set of hand holds 268 comprising cutouts located on opposing sides of the housing to allow the user to grab the structure during placement and removal. Size and fit tolerances within reactor-bed housing 256 are preferably established to ensure that, when assembled, the entire reactor bed assembly is airtight does not allow air leakage around the media beds.

Figure 27:
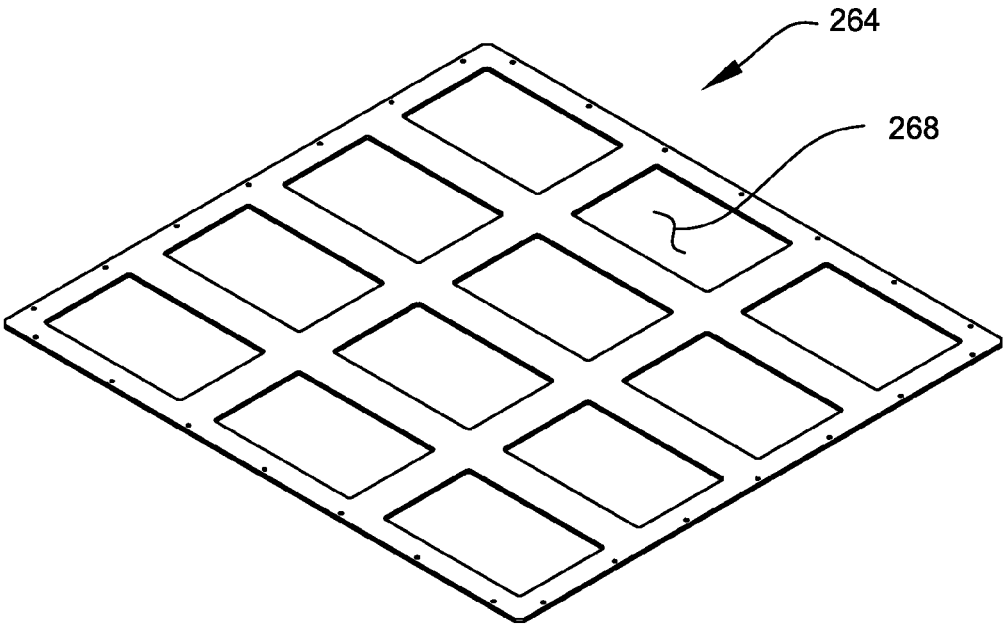
FIG. 27 shows a perspective view, illustrating a resilient wiper seal of the reactor bed.

FIG. 27 shows a perspective view, illustrating a resilient wiper seal 264 of reactor bed 216. Preferably, wiper seals 264 function to provide a seal around the $CO_2$ absorption modules 202. Reactor bed 216 preferably utilizes two wiper seals 264 that are preferably constructed of a resilient material with silicone rubber being most preferred. Thin wiper seal 264A preferably comprises a thickness of about 1/16 inch (about 1.6 millimeters). Thick wiper seal 264B comprises a preferred thickness of about ⅛ inch (about 3.2 millimeters). Thick wiper seal 264B is preferably functions as the outer (lower) seal while thin wiper seal 264A forms a preferred inboard seal. Each wiper seal 264 preferably contains a grid-like arrangement of apertures 268. Each aperture 268 is preferably sized to be about ½-inch smaller (about 13 millimeters) than the outer dimension of the $CO_2$ absorption modules 202 preferably providing about a ¼-inch interference (about 6.4 millimeters) on all sides. A bead of silicone caulking is preferably applied between wiper seals 264 and the adjacent spacers to ensure that there is no separation between seal layers. The preferred use of wiper seals 264 allows for some misalignment between reactor bed 216 and $CO_2$ absorption modules 202 during installation and preferably maintains a positive seal when the component is fully seated. It should also be noted that, in alternate preferred embodiments of present system, supplementary seals can be inserted preferably by adding additional spacers 262 and wiper seals 264.

Figure 28:
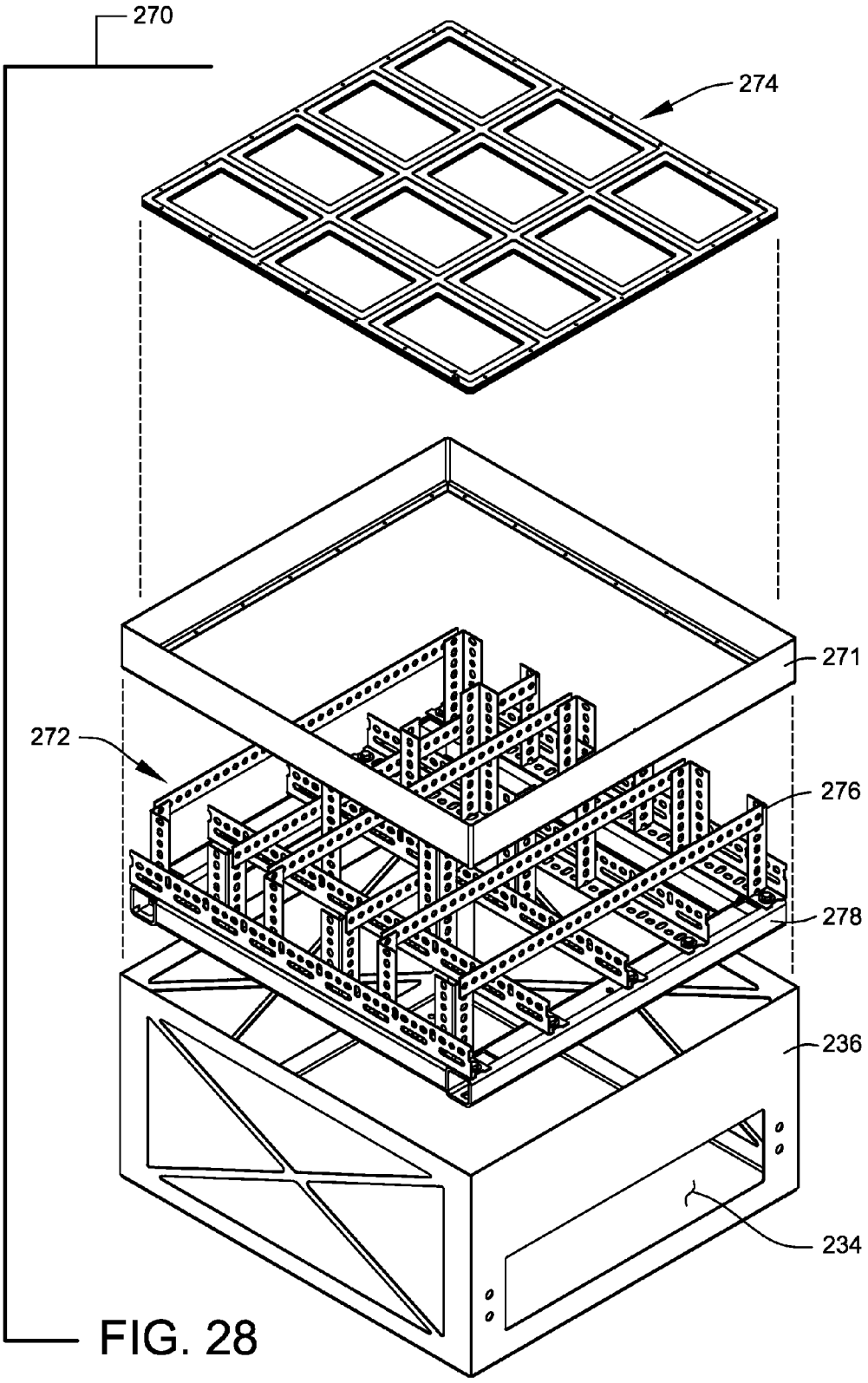
FIG. 28 shows a perspective view, illustrating a scrubbing-duct subassembly of the reactor-bed subassembly.

FIG. 28 shows a perspective view, illustrating scrubbing-duct subassembly 270 of scrubbing assembly 204. Scrubbing-duct subassembly 270 preferably comprises outer enclosure 236 to direct a flow of air from scrubbing assembly 204 into fan assembly 214. Outer enclosure 236 of scrubbing-duct subassembly 270 preferably houses support structure 272 for the array of $CO_2$ absorption modules 202 as well as the second wiper seal assembly 274 that preferably forms an airtight boundary around the array of $CO_2$ absorption modules 202.

Wiper seal assembly 274 is preferably mounted an elevation within the enclosure allowing wiper seal assembly 274 to engage $CO_2$ absorption modules 202. Outer enclosure 236 preferably comprises a flanged peripheral support member 271 that preferably functions to assist in supporting wiper seal assembly 274 at a preferred position within outer enclosure 236. Wiper seal assembly 274 is preferably secured using a bead of silicone caulking and one-way threaded fasteners, sealing washers, and nuts. The preferred use of one-way screws is intended to hinder unauthorized tampering with the assembly after installation. Wiper seal assembly 274 is preferably configured to form an airtight seal around $CO_2$ absorption modules 202 and any adjacent sealing interfaces.

Outer enclosure 236 is preferably constructed of sheet metal with 18-gauge steel being preferred. The sheet metal is preferably powder coated to avoid corrosion issues associated with moisture generated by occupant respiration and the refuge environment. Outer enclosure 236 is preferably configured to be completely sealed and airtight on all seems and only allow flow through the designed air pathway.

Support structure 272 is preferably configured to carry the weight of the twelve $CO_2$ absorption modules 202 and also supports the second wiper seal assembly 274 to reduce the likelihood of damage should a $CO_2$ absorption module 202 be dropped onto the assembly. It should be noted that the support structure is preferably designed not to block airflow through the modules, thereby keeping the functionality of the CO2 removal components optimized, while supporting their mass.

Support structure 272 preferably consists of an arrangement of perforated steel angles 276 supported on two inch by two inch square tubing 278. Horizontal sections of perforated steel angles 276 provide support for $CO_2$ absorption modules 202. Vertical sections of perforated steel angles 276 preferably extend upwardly to support wiper seal assembly 274.

Support structure 272 is preferably secured inside the sealed outer enclosure 236 by mechanical fasteners extending through the enclosure to engage the lower vibration-damping mounts 218. Upon reading this specification, those with ordinary skill in the art will now appreciate that, under appropriate circumstances, considering such issues as design preference, user preferences, marketing preferences, cost, structural requirements, available materials, technological advances, etc., other support arrangements such as, for example, molded unitary assemblies, the use of self-supporting modules, modifying the enclosure to include integrated support features, etc., may suffice.

Figure 29:
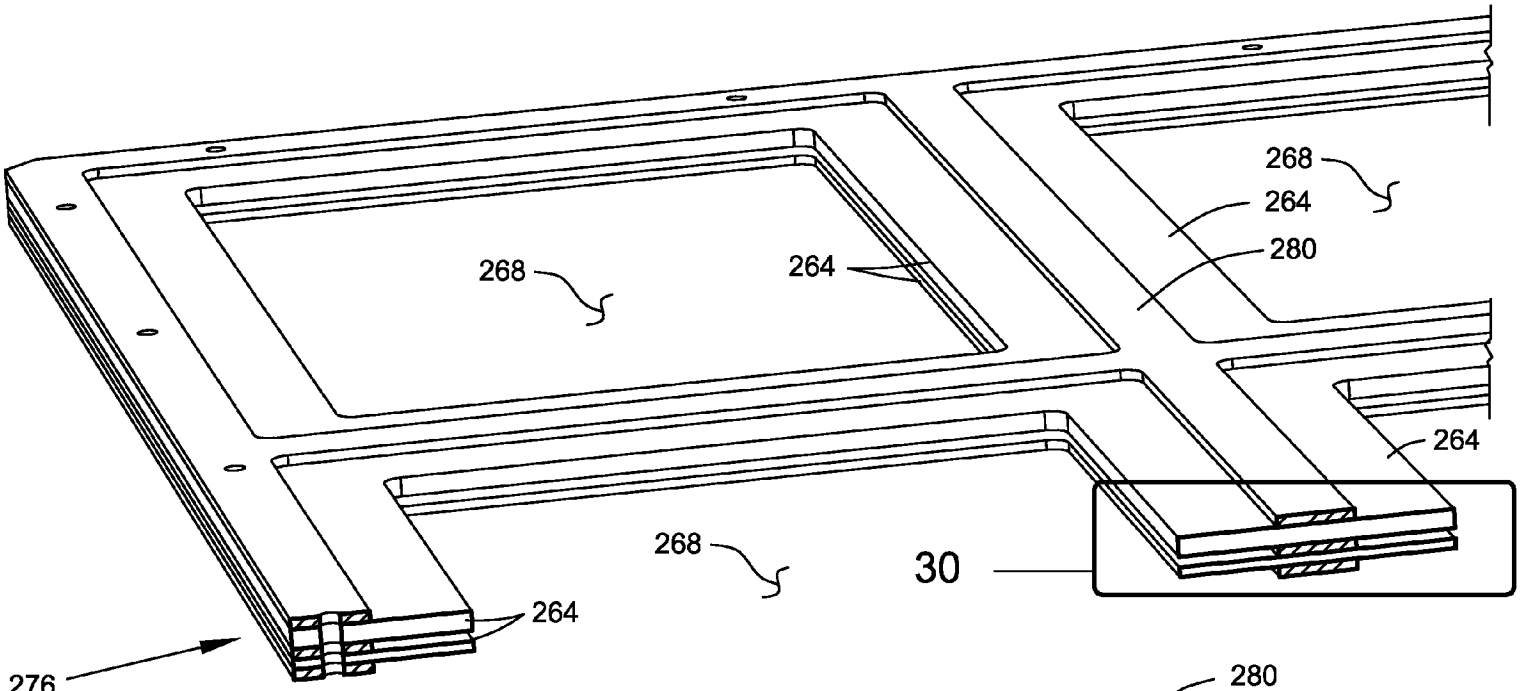
FIG. 29 shows a perspective view, in partial section, illustrating an assembled wiper-seal subassembly of the scrubbing-duct subassembly.
Figure 30:
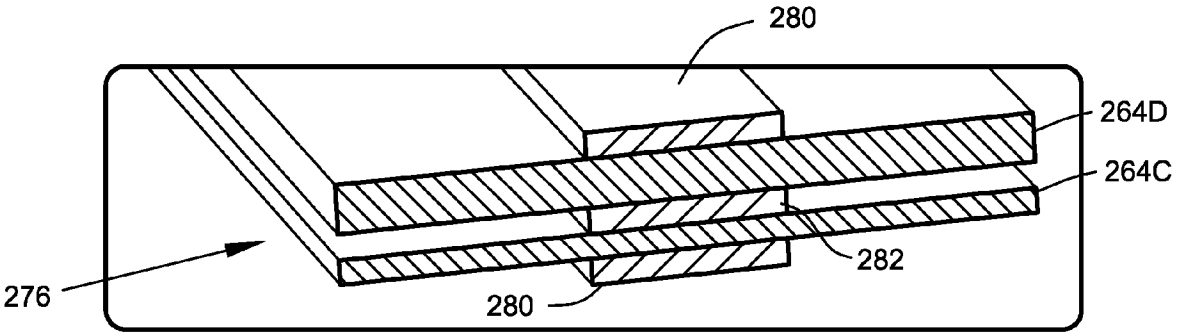
FIG. 30 shows a sectional view, magnified for clarity, of the sectional detail 30 of FIG. 29, illustrating preferred component arrangements of the wiper-seal subassembly.

FIG. 29 shows a perspective view, in partial section, illustrating an assembled wiper seal assembly 274. FIG. 30 shows a sectional view, magnified for clarity, of the sectional detail 30 of FIG. 29, illustrating preferred component arrangements of wiper seal assembly 274.

Wiper seal assembly 274 preferably utilizes two wiper seals 264 that are preferably constructed of silicone rubber. A thin wiper seal 264C preferably comprises a thickness of about 1/16 inch (about 1.6 millimeters). A thick wiper seal 264D is supplied with a preferred thickness of about 1/8 inch (about 3.2 millimeters). The thick wiper seal 264D preferably functions as the upper seal while thin wiper seal 264C preferably forms the lower seal. Each wiper seal 264 preferably contains a grid-like arrangement of apertures 268. Each aperture 268 is preferably sized about 1/2-inch smaller (about 13 millimeters) than the outer dimension of the $CO_2$ absorption modules 202 preferably providing about a 1/4-inch interference (about 6.4 millimeters) on all sides.

Preferably, wiper seals 264 are encapsulated by three braces providing support and rigidity. Wiper seals 264 are preferably encapsulated by two outer braces 280, preferably formed of 18-gauge steel sheet metal, and one inner brace 282 preferably comprising a 1/4-inch thick material (about 6.4 millimeters), preferably a metal, alternately preferably, a rigid plastic or high-durometer rubber. The metal brace is preferably powder coated steel as to limit corrosion. Preferably, the outer brace 280 contacts perforated steel angles 276 of support structure 272 in multiple locations to prevent dropping damage. A bead of silicone caulking is preferably placed along all points of contact between wiper seal assembly 274 and the supports to ensure the integrity of the assembly. A bead of silicone is also preferably placed between Wiper seal assembly 274 and outer enclosure 236 to remove any possible flow paths between the lower brace 280 and outer enclosure 236. All holes for fasteners are preferably drilled once wiper seal assembly 274 has been mated to the enclosure to avoid any misalignment.

Referring again to FIG. 4, air revitalization unit 200 is preferably placed in a corner of occupant enclosure 117 with the exhaust of the fan blowing down one wall while the side opposite the outlet rests against another. This preferred location takes up minimal floor space and provides thorough mixing of air throughout occupant enclosure 117.

During a change-out of $CO_2$ absorption modules 202, an occupant of emergency refuge 102 preferably removes reactor bed 216 from scrubbing assembly 204 to expose the twelve $CO_2$ absorption modules 202 forming $CO_2$ removal bed 206. Preferably, all twelve $CO_2$ absorption modules 202 are replaced simultaneously during a preferred change out procedure. Once the new $CO_2$ absorption modules 202 are installed, reactor bed 216 is preferably reseated on scrubbing assembly 204.

Upon reading this specification, those with ordinary skill in the art will now appreciate that, under appropriate circumstances, considering such issues as design preference, user preferences, marketing preferences, cost, structural requirements, available materials, technological advances, etc., other life-support arrangements such as, for example, the use of heat exchangers to remove excess heat from the refuge, humidity control units to remove excess humidity from the reguge, etc., may suffice. Furthermore, upon reading this specification, those with ordinary skill in the art will now appreciate that, under appropriate circumstances, considering such issues as design preference, user preferences, marketing preferences, cost, structural requirements, available materials, technological advances, etc., other life-support arrangements such as, for example, including a means for removing methane and other flammable gasses from a refuge, may suffice. In such an arrangement, a methane scrubber, utilizing a precious metal catalyst, would remove methane from the breathable atmosphere. Such a feature may use a low light off temperature catalyst in combination with a means for thermal control for the high temperature sustained reaction.

Figure 31:
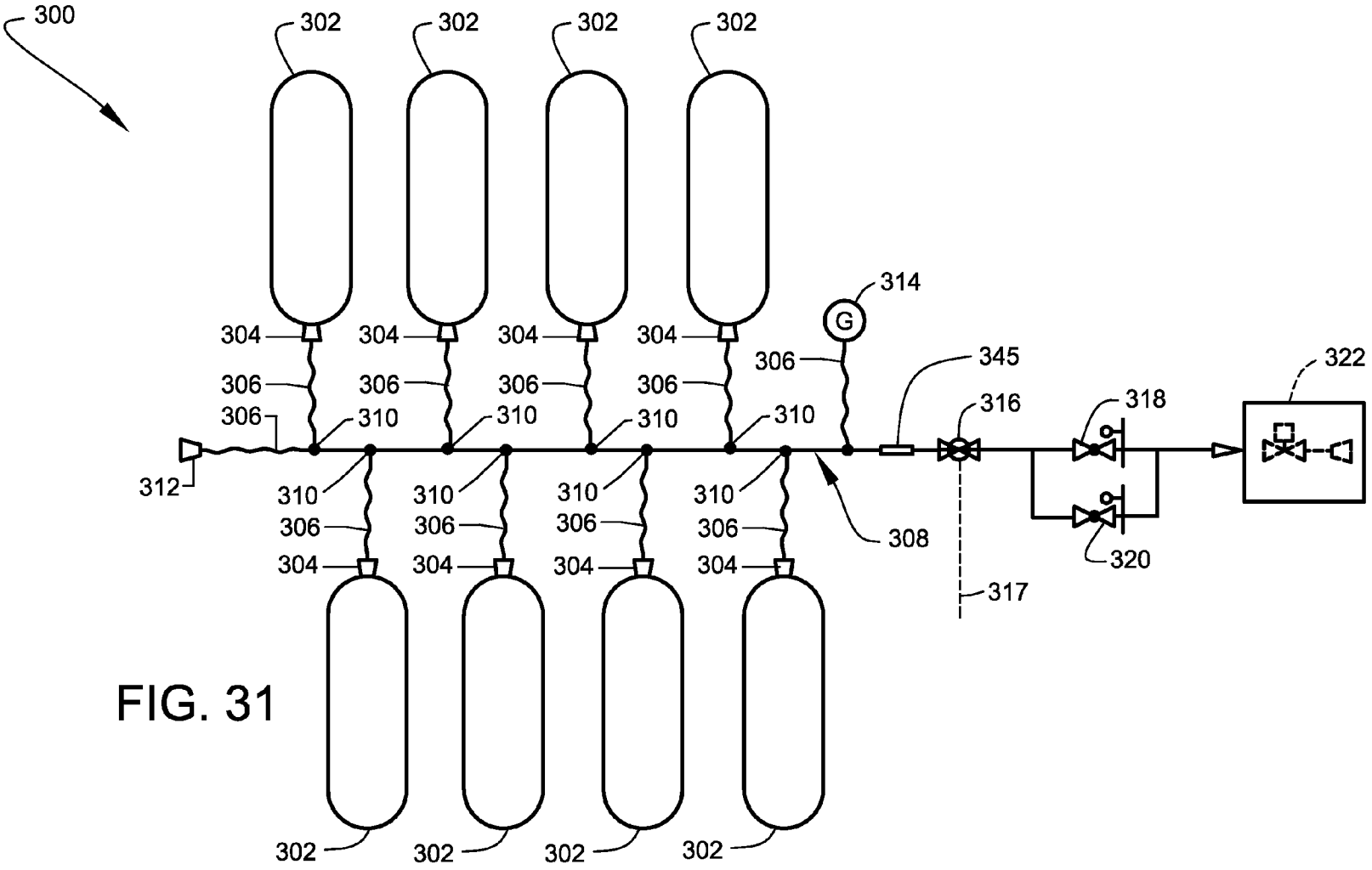
FIG. 31 Shows a schematic diagram illustrating a preferred oxygen distribution configuration, according to the preferred embodiment of FIG. 1.

FIG. 31 Shows a schematic diagram illustrating a preferred oxygen distribution subsystem 300, according to the preferred embodiment of FIG. 1. Oxygen distribution subsystem 300 is preferably designed to deliver safe concentrations of oxygen to occupant enclosure 117 in a manner reducing potential leakage pathways within the delivery subsystem.

Oxygen distribution subsystem 300 preferably eliminates the use of materials that are susceptible to stress corrosion cracking SCC, particularly the use of brass components serving compressed-gas cylinders used within oxygen distribution system 300. Preferably, stem valves in oxygen distribution subsystem 300 are made from materials that are resistant to SCC, such as, for example, high-nickel alloys or stainless steel. To reduce the cost of implementation, oxygen distribution subsystem 300 preferably uses an atypical distribution arrangement preferably designed to reduce the number of required components and points of potential leakage.

To maintain a level of compatibility with existing oxygen delivery systems, oxygen distribution subsystem 300 preferably uses components that are compatible with U.S. industry-standard 2640 psi oxygen storage. This preferably applies to components and materials upstream of the pressure regulator and the regulator itself. For example, oxygen distribution subsystem 300 preferably uses eight oxygen cylinders 302 preferably comprise U.S. standard industrial K-type oxygen cylinders 302, preferably pressurized to industry-standard 2640 pounds per square inch (psi). Oxygen is preferably delivered at U.S. industry standard 20 psi. Thus, components and materials downstream of the pressure regulator are preferably compatible with 20 psi oxygen systems.

Referring to the diagram of FIG. 31, oxygen cylinders 302 are preferably fitted with a machined cylinder adapter fitting 304, preferably 304L stainless steel, preferably adapting from 3/4 NGT (National Gas Taper) male threads to a 0.25 outside diameter (OD) by 0.035 wall by 0.75 long tube stub to accommodate the swaging attachment of a union (or metric equivalent). This union preferably comprises a 5000 psi axial swaged stainless steel union (or metric equivalent), preferably model DL3000-04 by Permaswage of Gardena, Calif., and is preferably used to adapt fitting 304 to flex hose 306. Permalite fittings are preferred because of their inherent low leakage, ease of assembly, and limited nondestructive examination and inspection requirements, as compared to welded connections, and ability to maintain oxygen-clean standards and levels.

Flex hose 306 preferably comprises corrugated stainless steel flex hoses to connect the cylinders (and other subsystem components) to the rigid tubing manifold. Flex hose 306 preferably comprises a double-walled, spirally welded, helical corrugated hose specifically designed for high-pressure applications. These flex lines are preferably rated for a working pressure of 4,600 psi with a preferred burst pressure of 18,400 psi. Preferred flex lines, suitable for use as flex hose 306, include model AF4555-1/4-X-12-IN-OAL by Hosemaster of Cleveland, Ohio. Flex hose 306 preferably comprises a 0.250 OD by 0.035 wall by 0.75 long 304 stainless steel tube stub on each end (or metric equivalent) to allow for connection to the Permalite fittings.

Rigid manifold 308 is preferably fabricated from 304 stainless steel tubing, ⅛ HD per AMS-T-6845 Type I (or metric equivalent) and preferably utilizes a plurality of connection tees 310. Tees 310 preferably comprise ¼, 5000 psi, axial swaged stainless steel, model DL3300-04 by Permalite (or metric equivalent).

Because oxygen cylinders 302 are delivered and connected empty, it is necessary to provide provisions to fill the system after integration. At least one Fill port 312 is preferably connected to rigid manifold 308 to allow for in-situ filling of oxygen distribution subsystem 300. Fill port 312 preferably comprises an oxygen check valve for balk pressure filling. Fill port 312 preferably comprises a non-standard component supplied by the Chase Filter Company of Newport News, Va. Fill port 312 preferably comprises model F1140-FV modified to comprise a valve assembly with a housing made of 304 stainless steel and 0.250 OD by 0.035 wall by 0.75 long tube stub for system connection (or metric equivalent).

An analog pressure gauge 314 is preferably coupled to rigid manifold 308 to permit monitoring of bulk-pressure degradation from the exterior of emergency refuge 102 through a viewport. Pressure gauge 314 preferably comprises a 0 to 3000 pound per square inch (psi) gauge of all stainless steel construction that is preferably oxygen clean. Analog pressure gauge 314 preferably comprises model 35-1009SW-JPLXFW6B 3000# by Ashcroft of Stratford, Conn.

Oxygen distribution subsystem 300 is preferably designed to permit initiation by a single user/occupant, or ingress, with no more than a single mechanical action. In this regard, rigid manifold 308 is preferably fitted with at least one actuation valve 316, preferably comprising a manual valve with a mechanism 317 for remote actuation. A preferred actuation valve 316 comprises model F1160-O2VA by Chase Filters and Components of Hampton, Va.

Oxygen distribution subsystem 300 preferably comprises a set of pressure regulators identified herein as primary pressure regulator 318 and secondary pressure regulator 320. Primary pressure regulator 318 preferably comprises a two-stage pressure regulator having 25 psi setpoint (or metric equivalent). Secondary pressure regulator 320 preferably comprises a two-stage pressure regulator having a 20 psi setpoint (or metric equivalent). Both pressure regulators preferably comprise model HP700P11R81NBKB pressure regulator by Conoflow of Westminster, S.C. At at least one high-pressure flow-limiting orifice fitting 345 is preferably installed prior to the pressure regulators, as shown.

Oxygen distribution subsystem 300 is preferably configured to deliver oxygen from the pressure regulators to at least one automatic oxygen introduction system 322, as shown. Preferred automatic oxygen introduction system 322 preferably functions properly meter oxygen from oxygen distribution subsystem 300 to occupant enclosure 117 and may preferably include oxygen monitors, actuated valves, filters, mufflers, etc. Oxygen distribution subsystem 300 preferably includes additional non-critical components well-known to those of ordinary skill in the art, including, sealants, standard adapters, volume chambers, etc.

Oxygen distribution subsystem 300 is preferably designed to prevent unintended tampering or off-specification adjustment of components. This preference prevents inexperienced occupants from adjusting or tampering with the oxygen supply system, which may result in undesirable or dangerous conditions within the refuge. Preferably, oxygen distribution subsystem 300 is designed to eliminate occupant-accessible valve handles. Preferably, accessible valves and similar components can only be shut-off using special tools. It is noted that any components of oxygen distribution subsystem 300 located within mechanical room 119 permit adjustments without the use of special tools.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims. Furthermore, although applicant has described applicant's preferred embodiments of this invention using metric standardized units, such measurements have been provided only for the convenience of the reader and should not be read as controlling or limiting. Instead, the reader should interpret any measurements provided in English standardized units as controlling. Any measurements provided in metric standardized units were merely derived through strict mechanical coding, with all converted values rounded to two decimal places.

What is claimed is:

1. A system relating to reducing contamination in a first area adjacent to a second area, which is potentially contaminable, while permitting passage of at least one object from the second area to the first area, comprising:

at least one passageway structured and arranged to permit passing the at least one object from the second area to the first area, wherein the at least one passageway is defined by an upper surface, a lower surface, a first lateral surface, and a second lateral surface; and a first separator inside the at least one passageway to separate the first area from the second area, wherein the first separator extends laterally across the at least one passageway from the first lateral surface to the second lateral surface, wherein the first separator comprises at least one inflatable bladder, the at least one inflatable bladder capable of dynamically conforming to a shape of the at least one object when passing the at least one object through the first separator, wherein the first separator includes one or more discharge sources configured to actively discharge purge gas during the passage of the at least one object through the first separator to displace contaminants from the passageway, wherein the first separator provides a releasable seal between the first area and the second area and between the upper surface and the lower surface, while permitting passage of the at least one object from the second area to the first area, wherein the releasable seal extends laterally across the at least one passageway from the first lateral surface to the second lateral surface.

2. The system, according to claim 1, wherein the first separator comprises a non-porous polymer coating configured to resist damage from the passing through of the at least one object and from contaminants.

3. The system, according to claim 1, further comprising:

a) at least one life-supporting enclosure structured and arranged to enclose such first area;

b) wherein the at least one life-supporting enclosure comprises at least one enclosure wall structured and arranged to enclose, within the first area, at least one breathable atmosphere for one or more human occupants; and c) wherein the first separator is structured and arranged to permit passage of the one or more human occupants, through the at least one enclosure wall, from the second area to the first area within the at least one life-supporting enclosure.

4. The system, according to claim 3, wherein:

a) said at least one life-supporting enclosure comprises at least one mine emergency refuge structured and arranged to provide refuge for miners during a period of mine contamination in a mine emergency.

5. The system, according to claim 4, further comprising:

a) at least one life-support unit structured and arranged to maintain the at least one breathable atmosphere in a condition consistent with sustaining the health of the one or more human occupants;

b) wherein said at least one life-support unit comprises at least one toxic-compound remover structured and arranged to remove at least one toxic compound from the at least one breathable atmosphere.

6. The system, according to claim 5, wherein said at least one toxic-compound remover comprises at least one carbon dioxide remover structured and arranged to remove carbon dioxide from the at least one breathable atmosphere.

7. The system, according to claim 5, wherein said at least one toxic-compound remover comprises at least one ammonia remover structured and arranged to remove ammonia from the at least one breathable atmosphere.

8. The system, according to claim 5, wherein said at least one toxic-compound remover comprises at least one carbon monoxide remover structured and arranged to remove carbon monoxide from the at least one breathable atmosphere.

9. The system, according to claim 8, wherein said at least one toxic-compound remover further comprises:

a) at least one carbon dioxide remover structured and arranged to remove carbon dioxide from the at least one breathable atmosphere; and b) at least one ammonia remover structured and arranged to remove ammonia from the at least one breathable atmosphere.

10. The system, according to claim 5, wherein said at least one life-support unit comprises:

a) at least one air conductor structured and arranged to conduct at least one airflow from the at least one breathable atmosphere;

b) at least one inlet to receive the at least one airflow comprising at least one portion of the at least one breathable atmosphere;

c) at least one outlet to release the at least one airflow from the at least one air conductor; and d) at least one air movement generator structured and arranged to generate movement of the at least one airflow between the at least one inlet and the at least one outlet;

e) wherein the at least one air conductor comprises said at least one toxic-compound remover; and f) wherein the at least one toxic compound is removed from the at least one breathable atmosphere by interaction between the at least one airflow and the at least one toxic-compound remover.

11. The system, according to claim 5, further comprising at least one oxygen maintainer structured and arranged to maintain, within the at least one breathable atmosphere, at least one life-sustaining level of oxygen.

12. The system, according to claim 1, wherein the at least one passageway comprises:

a) within at least one enclosure wall structured and arranged to enclose the first area, at least one entrance opening to provide entrance to the at least one passageway, b) the first separator, and c) a second separator structured and arranged to further separate the at least one passageway from the second area.

13. The system, according to claim 12, wherein said at least one passageway further comprises at least one third separator to further separate the first area from the second area.

14. The system, according to claim 13, wherein the at least one third separator comprises:

a) a deformable separator region structured and arranged to deform under at least one force load applied to the third separator by the at least one object, b) the at least one passageway structured and arranged to permit passing the at least one object through the third separator from the second area to the first area, and c) a deformation corrector structured and arranged to restore a releasable seal of the third separator for separating the first area from the second area.

15. The system, according to claim 1, wherein the at least one inflatable bladder comprises:

a) at least one continuous bladder wall structured and arranged to contain inflation fluid;

b) wherein the at least one continuous bladder wall comprises at least one flexible material capable of deforming under at least one force load applied to the at least one continuous bladder wall by the at least one object.

16. The system, according to claim 1, further comprising:

a) at least one cover hatch;

b) wherein the at least one cover hatch is structured and arranged to be configurable between an open position and a closed position;

c) wherein the at least one cover hatch, when configured in the open position, allows entry of the at least one object into the second area; and d) wherein the at least one cover hatch, when configured in the closed position, substantially prevents passage of contaminants into the second area.

17. The system, according to claim 16, further comprising:

a) a bladder inflator to inflate the at least one inflatable bladder using the purge gas;

b) wherein the bladder inflator comprises at least one controller configured to control delivery of the purge gas to each said at least one inflatable bladder of the first separator;

c) wherein the at least one controller comprises at least one trigger configured to trigger inflation of the at least one inflatable bladder when the at least one cover hatch is opened.

18. The system, according to claim 17, a) wherein the bladder inflator is structured and arranged to utilize breathable air as the purge gas;

b) wherein the at least one inflatable bladder comprises a flexible material that is at least partially permeable to the passage of the breathable air; and c) wherein at least a portion of the breathable air permeating from the at least one inflatable bladder displaces the contaminants within the at least one passageway.

19. The system, according to claim 1, wherein the first separator further comprises:

a) at least two fluid-inflatable bladders comprising at least one upper fluid-inflatable bladder and at least one lower fluid-inflatable bladder;

b) wherein said at least one upper fluid-inflatable bladder comprises at least one upper deformable separator region and said at least one lower fluid-inflatable bladder comprises at least one lower deformable separator region;

c) wherein said at least one upper deformable separator region is arranged to be in separable contact with said at least one lower deformable separator region; and d) wherein the at least one passageway through the first separator is formed by sufficient deformation of either one of said at least one upper deformable separator region and said at least one lower deformable separator region.

20. The system, according to claim 19, wherein:

a) contact between said at least one upper deformable separator region and said at least one lower deformable separator region forms at least one releasable passage seal structured and arranged to releasably seal the at least one passageway formed between said at least two fluid-inflatable bladders;

b) wherein said at least one releasable passage seal prevents passage of the contaminants through the first separator.

21. The system, according to claim 20, wherein each one of said at least two fluid-inflatable bladders comprise a tubular shape having a lateral length extending between at least one first end closure and at least one second end closure.

22. The system, according to claim 20, further comprising:

a) at least one bladder inflator to inflate said at least two fluid-inflatable bladders using the purge gas; and b) wherein the at least one bladder inflator comprises at least one controller to control delivery of the at least one purge gas to each said at least two fluid-inflatable bladders of the first separator.

23. The system, according to claim 21, wherein:

a) said at least one releasable passage seal extends continuously along said lateral length; and b) said at least one releasable passage seal is oriented substantially horizontally.

24. The system, according to claim 1, wherein the one or more discharge sources are configured to provide uni-directional permeation of fluid from the first separator to the at least one passageway.

25. The system, according to claim 1, wherein the inflatable bladder includes a first section and a second section, wherein the first section is permeable to air and includes the one or more discharge sources distributed laterally across the first section from the first lateral surface to the second lateral surface, and wherein the second section is substantially impermeable to air.

26. A mine emergency refuge system, for providing at least one protective enclosure as a refuge for one or more persons during a period of mine contamination in a mine emergency, comprising:

at least one separator structured and arranged to separate at least one contaminable mine area from at least one adjacent mine refuge area; and at least one passageway structured and arranged to permit passing the one or more persons through the at least one separator from the contaminable mine area to the mine refuge area, wherein the at least one passageway is defined by an upper surface, a lower surface, a first lateral surface, and a second lateral surface, wherein the at least one separator extends laterally across the at least one passageway from the first lateral surface to the second lateral surface, wherein the at least one separator comprises at least one inflatable bladder, the at least one inflatable bladder capable of dynamically conforming to a shape of the one or more persons when passing the one or more persons through the at least one separator, wherein the at least one separator includes one or more discharge sources configured to actively discharge purge gas during the passage of the one or more persons through the at least one separator to displace contaminants from the at least one passageway, wherein the at least one separator provides a releasable seal between the at least one mine refuge area and the at least one contaminable mine area and between the upper surface and the lower surface while permitting passage of the one or more persons from the at least one contaminated mine area to the at least one mine refuge area, wherein the releasable seal extends laterally across the at least one passageway from the first lateral surface to the second lateral surface.

27. The mine emergency refuge system, according to claim 26, further comprising:

a) such at least one protective enclosure;

b) wherein said at least one protective enclosure comprises at least one enclosure wall structured and arranged to enclose at least one breathable atmosphere for the one or more persons; and c) wherein said at least one separator is structured and arranged to permit passage of the one or more persons, through said at least one enclosure wall, from the at least one contaminable mine area to the at least one mine refuge area within said at least one protective enclosure.

28. The mine emergency refuge system, according to claim 27, wherein said at least one protective enclosure comprises:

a) at least one life-support subsystem structured and arranged to provide life-support to the one or more persons during the period of mine contamination in the mine emergency;

b) wherein said at least one life-support subsystem comprises c) at least one oxygen maintainer structured and arranged to maintain, within said at least one protective enclosure, at least one breathable atmosphere comprising at least one life-sustaining level of oxygen; and d) at least one toxic-compound remover structured and arranged to remove at least one toxic compound from the at least one breathable atmosphere.

29. The mine emergency refuge system, according to claim 26, wherein:

the at least one inflatable bladder includes a first section and a second section, wherein the first section is permeable to air and includes the one or more discharge sources distributed laterally across the first section from the first lateral surface to the second lateral surface, and wherein the second section is substantially impermeable to air.

30. A system, relating to reducing contamination potential in a first area adjacent to a contaminated second area while permitting passage of at least one object from the contaminated second area to the first area, comprising:

separator means for separating the first area from the contaminated second area in a passageway connecting the first area to the contaminated second area, the passageway defined by an upper surface, a lower surface, a first lateral surface, and a second lateral surface, wherein the separator means extends laterally across the passageway from the first lateral surface to the second lateral surface;

wherein said separator means comprises at least one inflatable means for dynamically conforming to a shape of the at least one object when passing the at least one object through the separator means, the separator means comprising one or more discharging means for actively discharging purge gas from the inflatable means during passage of the at least one object passing through the separator means to displace contaminants from the passageway;

wherein the separator means provides a releasable seal between the first area and the contaminated second area and between the upper surface and the lower surface while permitting passage of the at least one object from the contaminated second area to the first area, wherein the releasable seal extends laterally across the passageway from the first lateral surface to the second lateral surface.

31. The system, according to claim 30, wherein the at least one inflatable means includes a first section and a second section, wherein the first section is permeable to air and includes the one or more discharging means distributed laterally across the first section from the first lateral surface to the second lateral surface, and wherein the second section is substantially impermeable to air.

32. A system relating to reducing cross contamination during passage of at least one person or object through a passageway extending between an enclosable life-supporting refuge and least one contaminated environment, said system comprising:

at least one air-inflatable separator to separate the enclosable life-supporting refuge and the least one contaminated environment, the passageway defined by an upper surface, a lower surface, a first lateral surface, and a second lateral surface;

wherein said at least one air-inflatable separator comprises at least one air-inflatable tube having at least one flexible outer wall, wherein the at least one air-inflatable separator extends laterally across the passageway from the first lateral surface to the second lateral surface;

wherein said at least one air-inflatable tube is capable of dynamically conforming to a shape of the at least one person or object when passing the at least one person or object through the air-inflatable separator, the at least one air-inflatable separator including one or more discharge sources configured to actively discharge purge gas from the at least one air-inflatable tube during passage of the at least one person or object through the at least one air-inflatable separator to displace contaminants from the passageway;

wherein the at least one air-inflatable separator provides a releasable seal between the enclosable life-supporting refuge and the at least one contaminated environment and between the upper surface and the lower surface while permitting passage of the at least one person or object from the least one contaminated environment to the enclosable life-supporting refuge, wherein the releasable seal extends laterally across the passageway from the first lateral surface to the second lateral surface.

33. The system, according to claim 32, further comprising a cover hatch configured to open to allow entry of the at least one person or object into the at least one contaminated environment and a controller, wherein the controller comprises a trigger configured to trigger delivery of the purge gas when the cover hatch is opened.

* * * * *